US007592743B2

(12) United States Patent
Yamatoda et al.

(10) Patent No.: US 7,592,743 B2
(45) Date of Patent: Sep. 22, 2009

(54) COMPENSATION OF WARPING IN DISPLAY APPARATUS SUBSTRATE

(75) Inventors: Takeshi Yamatoda, Kanagawa-ken (JP); Mitsutoshi Kuno, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 561 days.

(21) Appl. No.: 11/302,239

(22) Filed: Dec. 14, 2005

(65) Prior Publication Data

US 2006/0138926 A1 Jun. 29, 2006

(30) Foreign Application Priority Data

Dec. 27, 2004 (JP) ..... 2004-376642

(51) Int. Cl.
*H01J 1/62* (2006.01)
*H01J 63/04* (2006.01)

(52) U.S. Cl. ..... 313/496; 313/495; 313/497; 313/346 R

(58) Field of Classification Search ..... 313/495–497, 313/310, 346 R
See application file for complete search history.

(56) References Cited

U.S. PATENT DOCUMENTS 6,121,942 A 9/2000 Sanou et al. ..... 345/75
6,140,985 A * 10/2000 Kanai et al. ..... 345/74.1
6,534,924 B1 3/2003 Oguchi et al. ..... 315/169.1
6,888,519 B2 5/2005 Yamano et al. ..... 345/75.2
2005/0148272 A1 7/2005 Yamano et al. ..... 445/63
2005/0264166 A1 * 12/2005 Ando ..... 313/495

FOREIGN PATENT DOCUMENTS

| | | |
|---|---|---|
| JP | 5-174742 | 7/1993 |
| JP | 8-171875 | 7/1996 |
| JP | 9-213246 | 8/1997 |

* cited by examiner

*Primary Examiner*—Nimeshkumar D. Patel
*Assistant Examiner*—Thomas A Hollweg
(74) *Attorney, Agent, or Firm*—Fitzpatrick, Cella, Harper & Scinto

(57) ABSTRACT

A miss landing measure on a face plate of electrons emitted from electron-emitting devices by the warping of a rear plate and the face plate accompanying heat processes, such as seal bonding, is provided. Initial velocity vectors of electrons emitted from an electron-emitting area of an electron-emitting device formed on the rear plate has a distributed tendency according to an in-plane distribution of normal line directions of the rear plate so that the electrons emitted from each of the plurality of electron-emitting devices may irradiate each of the plurality of light emitting portions, corresponding to each of the electron-emitting devices, formed on the face plate.

5 Claims, 19 Drawing Sheets

COMPENSATION OF WARPING IN DISPLAY APPARATUS SUBSTRATE

BACKGROUND OF THE INVENTION

1. Field of the Invention

The present invention relates to an image display apparatus to which electron-emitting devices are applied.

2. Description of Related Art

In recent years, because a flat plane display apparatus having a thin depth can save a space and has been light in weight, the flat plane display has attracted attention as a display in place of a cathode-ray type display apparatus among image display apparatus using electron-emitting devices.

Such a flat plane display apparatus has a hermetic container produced by joining a rear plate equipped with electron-emitting devices and a face plate equipped with a light emitting member (phosphor), which emits light by the radiation of an electron beam, with a frame member put between them. Highly precise alignment between the rear plate and the face plate is required for producing the hermetic container. However, as the display apparatus has become larger in size, the occurrence frequency of misalignment has become higher, and a measure has been required. As one of the measures, Patent Document 1 discloses the corrections of the offsets of the electron incident positions of electron beams caused by the misalignment by controlling the trajectories of electron beams by controlling the drive of electron-emitting devices in a display apparatus in which the misalignment has occurred.

Moreover, although it does not concern the offsets of electron beam incident positions caused by misalignment, Patent Document 2 discloses the corrections of the shifts of the radiation positions of electron beams caused by a curved shape (warping shape) of a display apparatus using electron-emitting devices by controlling phosphor pitches.

(Patent Document 1) Japanese Patent Application Laid-Open No. H08-171875 (U.S. Pat. No. 6,121,942)

(Patent Document 2) Japanese Patent Application Laid-Open No. H05-174742

Because in the above display apparatus using a hermetic container a jointing material is heated when the hermetic container is produced, thermal expansion and contraction arise in each of a face plate, a rear plate, and a frame member. However, it has become clear that if the expansion and contraction quantities differ in each member, residual stresses arise among each member to cause warping in the hermetic container as a result. Because the warp becomes larger as the display apparatus becomes larger, in some cases, a new problem in which the electron incident positions of electron beams differ from the desired positions and the dispersion of luminance and colors arises as a result is caused. The present invention relates to the provision of a novel display apparatus capable of dealing with the warping arising in a display apparatus to display a good image.

SUMMARY OF THE INVENTION

For solving the problem mentioned above, the present invention is a display apparatus including:

an electron source substrate having an electron source including a plurality of electron-emitting devices, each having an electron-emitting area between a pair of electrodes, a plurality of row directional wirings and a plurality of column directional wirings, both of the wirings connecting the plurality of electron-emitting devices; and a counter substrate located in opposition to the electron source substrate, the counter substrate including a plurality of light emitting portions corresponding to the plurality of electron-emitting devices, wherein in the electron source substrate, directions of normal lines of a surface of an electron source forming region are distributed in a tendency, and initial vectors of electrons emitted from the electron-emitting areas of the electron-emitting devices are distributed in a tendency corresponding to the distributed tendency of the normal line direction so that electrons emitted from each of the plurality of electron-emitting devices may irradiate each of the plurality of light emitting portions which corresponds to the electron-emitting device.

BRIEF DESCRIPTION OF THE DRAWINGS

FIGS. 1A, 1B, 1C and 1D are views for illustrating the warping of an image display apparatus of the present invention, in which FIG. 1A is a sectional view of the image display apparatus, FIG. 1B is a view showing the offsets of the electron incident positions of electron beams in the case where the lengths of the corresponding parts of a face plate and a rear plate are different from each other, FIG. 1C is a view showing the offsets of electron incident positions in the case where the corresponding parts of the face plate and the rear plate are the same, but the parallel positions of the corresponding parts are offset from each other, and FIG. 1D is a view showing the offsets of electron incident positions in the case where the face plate and the rear plate are not in parallel;

DESCRIPTION OF THE PREFERRED EMBODIMENTS

First, the objects of the present invention are ones shown below.

An electron-emitting device applicable to the present invention includes a field emission type device, an MIM type device, a surface conduction electron-emitting device, and the like. In particular, because emitted electrons of the surface conduction electron-emitting device have the components of velocities parallel to the image display surface thereof, beam position correction by the electron source thereof by itself is easy, and the surface conduction electron-emitting device is a desirable form to which the present invention is applied from this viewpoint.

An image display apparatus of the present invention is an electron beam display apparatus.

Before the preferred embodiments of the present invention is shown, the configuration of the image display apparatus to be an object of the present invention is concretely described by illustrating a surface conduction electron-emitting device as an example.

Figure 3:
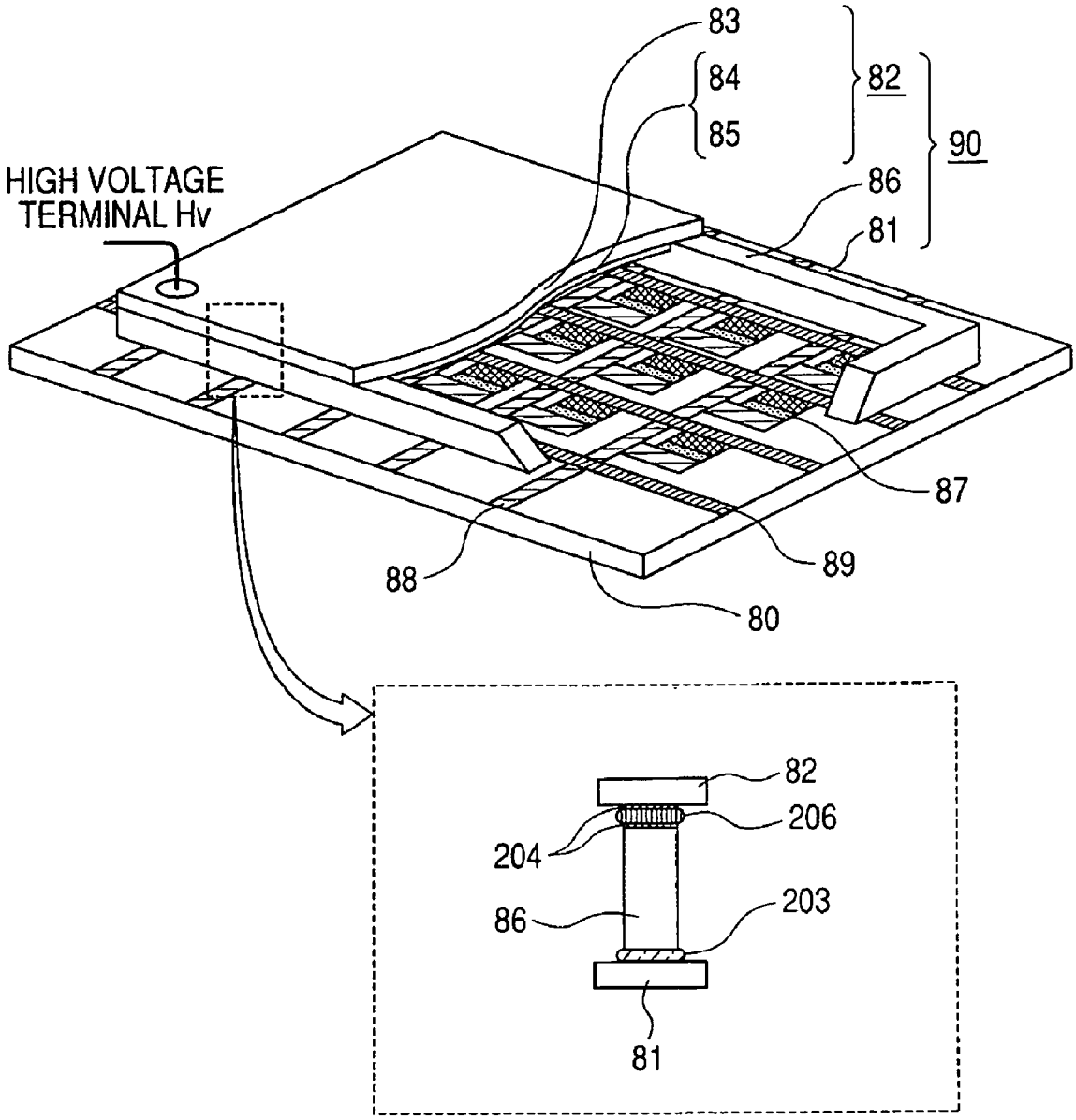
FIG. 3 is a view for illustrating the image display apparatus structure of a display apparatus, which view is composed of a partially broken perspective view of the image display apparatus and an enlarged sectional view of a seal bonding portion of the display apparatus.

A conventional image display apparatus using an electron source substrate which has surface conduction electron-emitting devices arranged in a matrix is shown in FIG. 3. As apparent from FIG. 3, in the image display apparatus, a rear plate 81 on which the many surface conduction electron-emitting devices 87 are arranged in a matrix and a face plate 82 made by forming a phosphor 84, a metal back 85 and the like on the inner surface of a glass substrate 83 are arranged in opposition to each other with a supporting frame 86 put between them. These rear plate 81, supporting frame 86 and face plate 82 adhere to one another with a joining member represented by fit glass and indium (In), and a member performing the seal bonding of the rear plate 81, the supporting frame 86 and the face plate 82 is a vacuum envelope 90. X-directional wiring 88 and Y-directional wiring 89, which are connected to a pair of device electrodes of each of the surface conduction electron-emitting devices 87 are formed on the rear plate 81.

In the image display apparatus mentioned above, when a voltage Vf for driving a device of ten-odd V is selectively applied between the device electrodes of a surface conduction electron-emitting device element 87 through the X-directional wiring 88 and the Y-directional wiring 89, electrons are emitted from the surface conduction electron-emitting device 87. The emitted electrons reach the face plate 82 having an anode, to which a voltage of several kV is applied through a high voltage terminal Hv, and make the phosphor 84 emit light.

A part in FIG. 3 enclosed by a broken line is an enlarged view of the seal bonding structure. In the seal bonding structure, in order to absorb the difference between the contraction quantities of the plates made of different kinds of glass materials which have been subjected to various thermal and mechanical processes, and warping of the plates, a material having a high drawing property such as indium is used as a joining member 206. Thereby, a vacuum leak caused by a fissure or the like is avoided. However, warping remains in the completed envelope 90 owing to a residual stress, and the warping becomes more remarkable as the image display apparatus becomes larger in size.

Figure 2:
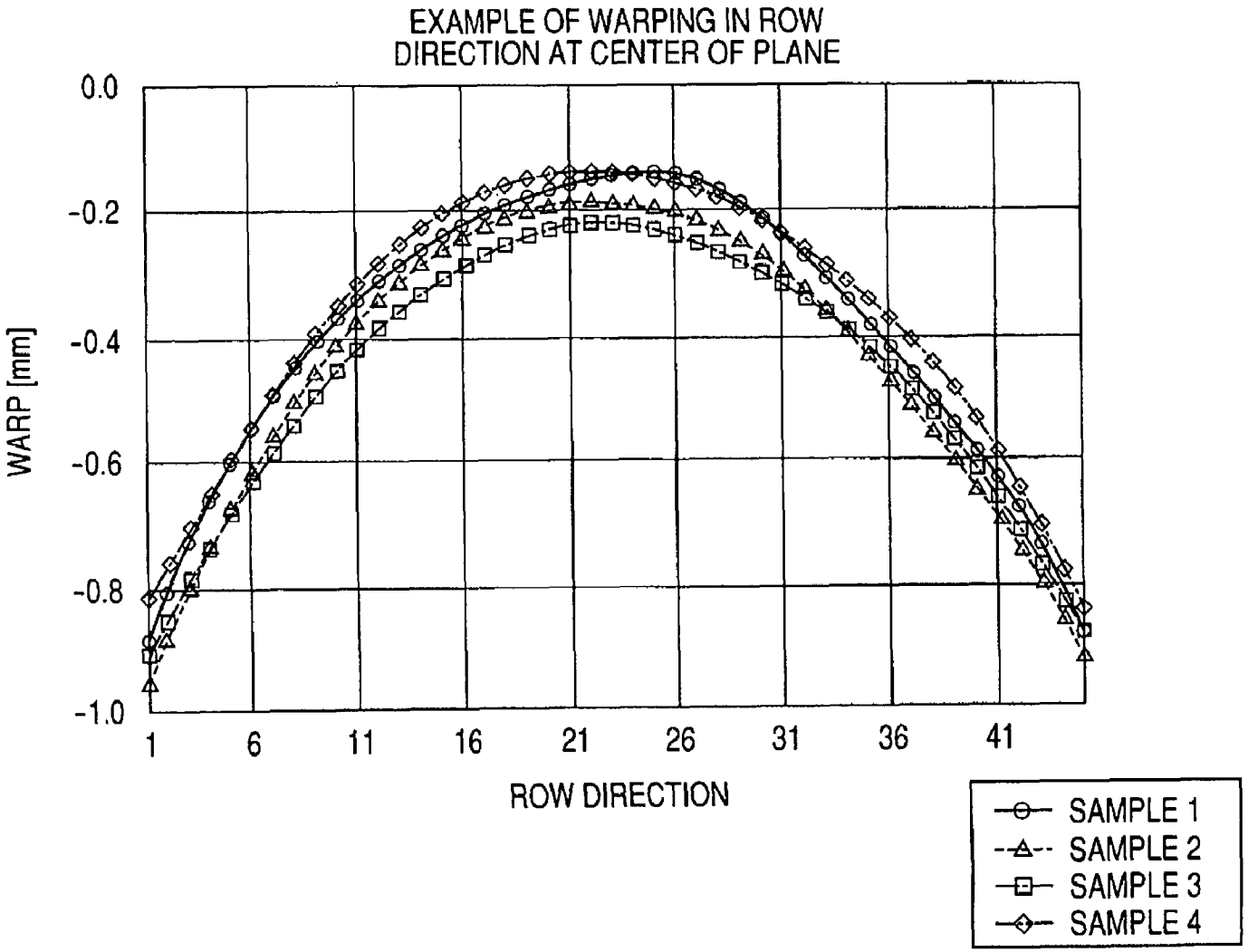
FIG. 2 is a diagram showing warps in the X-directions of sample substrates of four completed image display apparatus.

Four examples about the warping produced in an image display apparatus are shown in FIG. 2. In this case, the total quantity of warping (the maximum quantity of warping) is about 1 mm, and the dispersion of the warping to the total quantity of the warping is reproducible within about 0.1 mm. It has been ascertained from our research that the reproducibility especially depends on the heating performance of a seal bonding apparatus at a seal bonding process and the reproducibility is high when the same apparatus is used. Then, in this case, the maximum of the in-plane dispersion of the thickness of an image display apparatus is about 0.1 mm, and it can be said that the rear plate and the face plate are parallel over the almost whole in-plane area.

Originally, when an image display apparatus is a flat plane, there is a light emitting portion corresponding to each electron-emitting device at a place at which a normal line of the rear plate extended from each electron-emitting device of the rear plate intersects the face plate. However, as shown in FIGS. 1A-1D, when the image display apparatus has warped, the corresponding light emitting portion of the face plate is offset from an intersection point with the normal line of the rear plate extended from the electron-emitting device. Thus, when warping exists in an image display apparatus, an electron beam emitted from an electron-emitting device on the rear plate reaches at a position offset from the position at which the electron beam should originally reach. The offset causes the dispersion in luminance and color, and deteriorates image quality.

Although the degree of the warping of an image display apparatus is reproducible between image display apparatus, the degree is not constant in the image display region of one image display apparatus. Therefore, also the relations among typical normal lines indicated by the letters of from θa to θi shown in FIG. 1 are not necessarily prescribed especially by a certain function. In this case, any measure for the positional offsets should be examined to each individual region in the image display region.

Figure 1A:
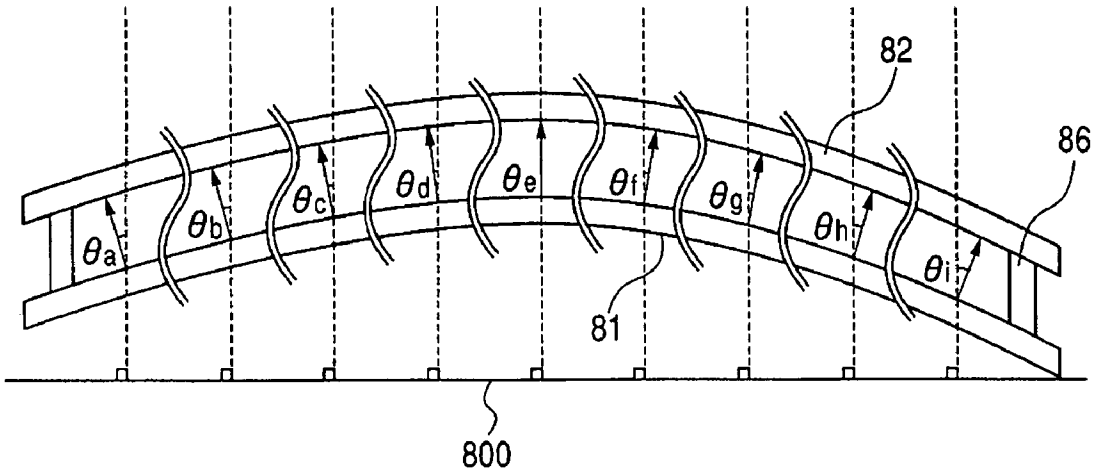
Figure 1B:
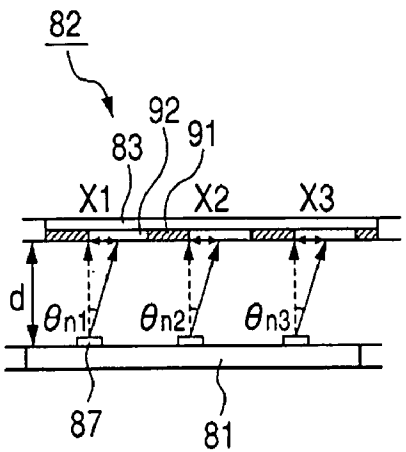
Figure 1C:
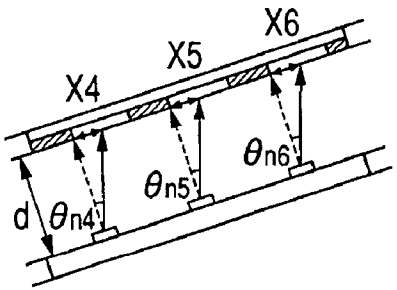
Figure 1D:
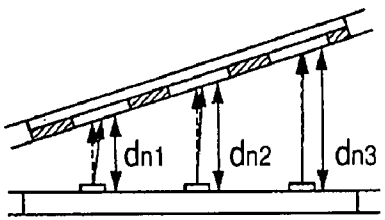

As the state of the positional offset owing to the warping, the following three states shown in FIGS. 1B-1D can be considered according to the positions of individual electron-emitting devices.

The state shown in FIG. 1B is the case where the relative position of the rear plate and the face plate has been offset into a direction parallel to the opposed surfaces of the face plate and the rear plate due to the difference of the contraction quantities of the rear plate and the face plate.

The state shown in FIG. 1C is the case where an intersection point of the normal line of the rear plate extended from each electron-emitting device with the face plate has been offset from a corresponding display portion because the rear plate and the face plate finally have similar warping, subjected to the seal bonding.

The state shown in FIG. 1D is the case where intersection points of the normal lines of the rear plate extended from electron-emitting devices with the face plate have been offset from corresponding display portions because the rear plate and the face plate have been subjected by the seal bonding in a non-parallel state.

In the cases shown in FIGS. 1B and 1C, an angle θ formed by a vector extending from an electron-emitting device to a corresponding light emitting portion and a normal line vector on the rear plate is expressed by $x=d\times\tan\theta$ pertaining to the offset x of the electron incident position of an electron beam on the face plate. That is, there is no need to distinguish the offsets of the cases shown in FIGS. 1B and 1C. When the offset x of the electron incident position of an electron beam can be known, the angle θ mentioned above, which has been caused by the influences of the cases shown in FIGS. 1B and 1C, can be known. Accordingly, by using the means for correcting the angle θ arbitrarily over a surface, the deterioration of image quality caused by the warping of the image display apparatus can be avoided.

In view of the display apparatus which has the warping shown in the example of FIG. 2, the case shown in FIG. 1D has almost no need to be considered. The reason is that the in-plane dispersion of the thickness of the display apparatus is small in the case of the display apparatus illustrated in FIG. 2. However, for an image display apparatus in which the face plate and the rear plate is non-parallel in their norm design, there is a case where the disposition relation shown in FIG. 1D produces a problem, and it becomes necessary to deal with the situation.

It is an object of the present invention to provide an image display apparatus having high visual quality by performing the correction of the offsets of light emitting positions caused by the warping of the image display apparatus shown in FIGS. 1B and 1C mentioned above by forming in-plane distributions in electron beam trajectories.

The image display apparatus of the present invention is characterized by forming an in-plane distribution so that the initial velocity vector of an electron emitted from each of a plurality of electron-emitting devices located on a rear plate having warping may irradiate a corresponding light emitting portion. Moreover, it is more preferable to form a distribution of the positions of the light emitting portions so as to agree with the in-plane distribution of the electron beam characteristic on the rear plate side.

In the following, the preferable embodiments of the present invention are described.

In order to achieve that on initial velocity vector of an electron beam forms a particular in-plane distribution, it is desirably that the device electrodes are inclined so that electron beam trajectory shown in FIG. 4 inclines in relation to X-direction as described with reference to FIG. 10 as follow.

Moreover, it is preferable to form an electron-emitting area at a predetermined angle position on an electrode by forming the shape of a device electrode in an arc to make it possible to select the initial velocity vector of an electron beam arbitrarily as it will be described later by referring to FIG. 12. That is, it is preferable to make an electron beam incident position agree with a corresponding correct position of a face plate by forming an in-plane distribution in the positions of emitting portions.

For making the initial vectors of electrons have an in-plane distribution, it is preferable to realize the in-plane distribution by forming the in-plane distribution in the initial vectors of the electron beams, for example, by adjusting a voltage Vf for driving a device as it will be described later by referring to FIG. 14.

Figure 17:
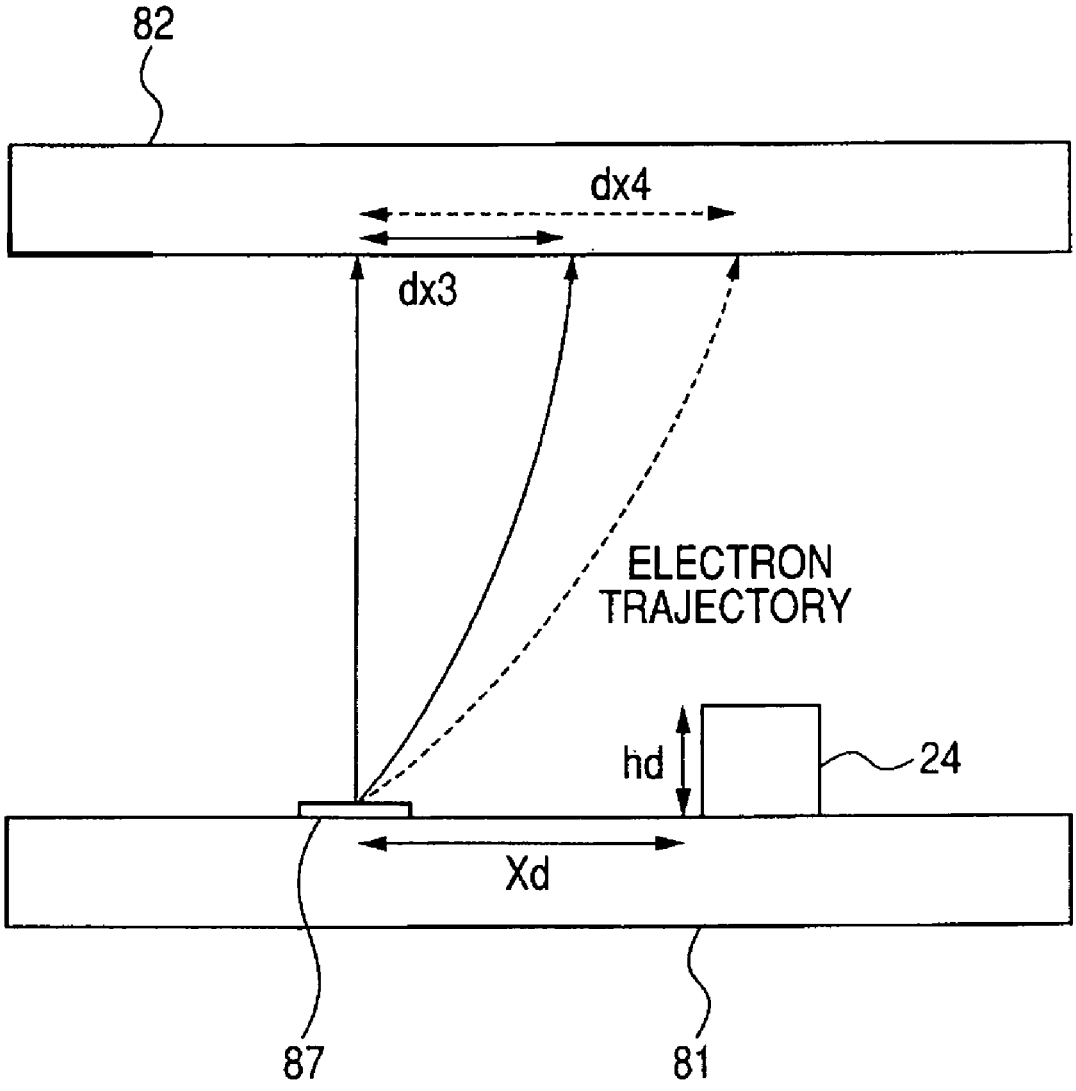
FIG. 17 is a view showing horizontal electron beam incident distances under the existence of Y-directional wiring in a third embodiment of the present invention.

For making the trajectories of electrons have an in-plane distribution, it is preferable to realize the in-plane distribution by forming the in-plane distribution in beam control effect by a matrix configuration. To put it more concretely, it is preferable to realize the in-plane distribution by controlling the height of Y-directional wiring and the distances of adjoining electron-emitting devices as it will be described later by referring to FIG. 17.

Figure 20:
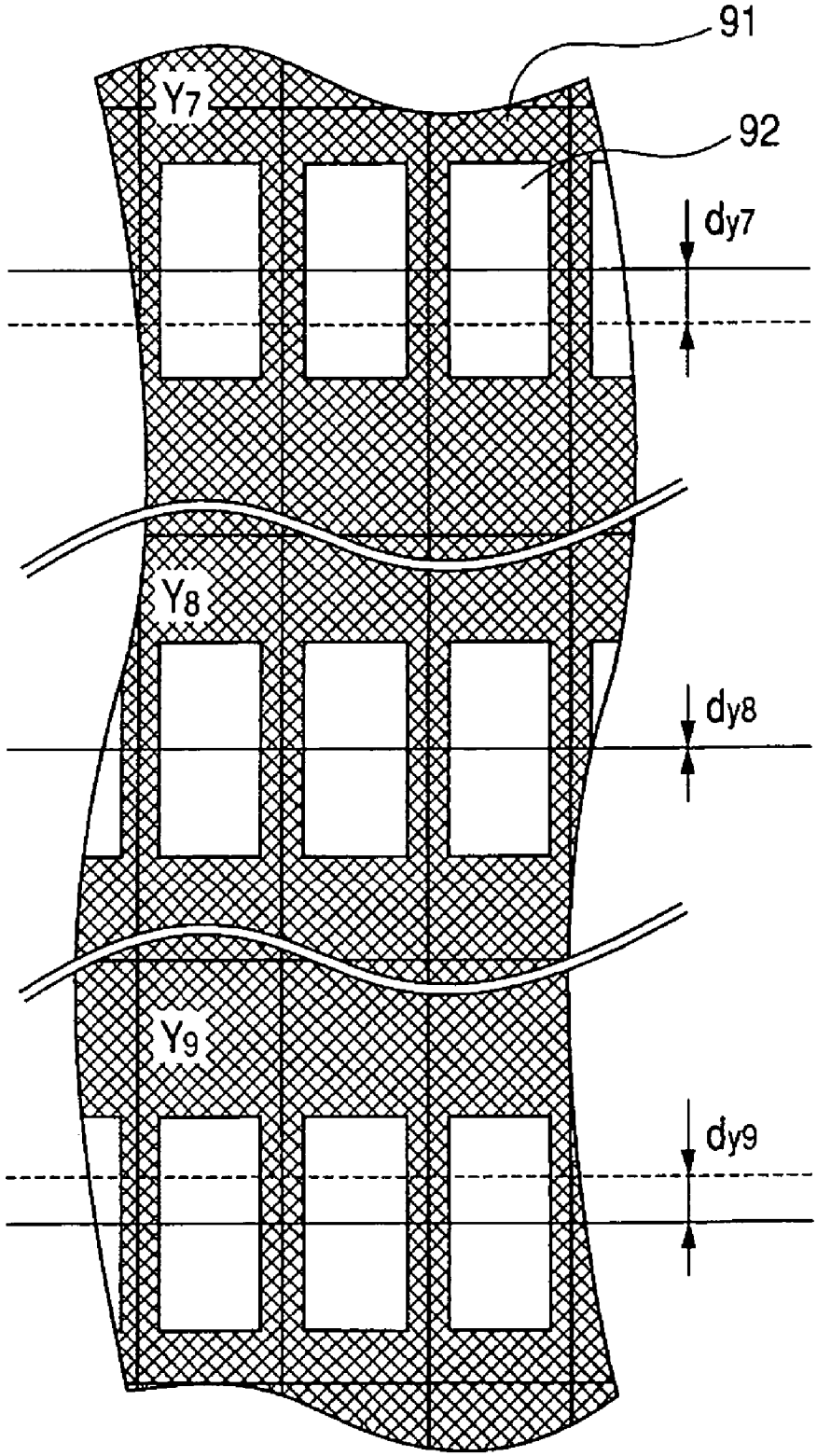
FIG. 20 is a view showing relations between phosphors and the positions of a black conductive material.

In any cases mentioned above, it is still better to give the in-plane distribution furthermore at the light emitting portions of the face plate within a field in the position of the light emitting portion of a face plate. More specifically, it is realized by changing the phosphor positions of the face plate as it will be described later by referring to FIG. 20. Thereby, it becomes possible to correct a large positional offset which cannot be dealt with only by forming a distribution in the vectors of emitted electrons. Moreover, it becomes possible to perform more fine adjustment of electron incident positions.

In order to explain the warp that have to be correct, an ideal surface as a reference surface is described. It is suitable that the reference surface used as the target value of correction is basically a surface perpendicular to the average value of normal lines. The reason is that the correction quantity of each system becomes equal. When the warping produced near to an end of an image display apparatus is large to the degree of making it impossible to perform the correction of a positional offset, an individual reference surface may be calculated by using only the normal line at the end region of the image display apparatus. Moreover, it is preferable to form the reference surface as a curved surface because the curved reference surface makes it possible to perform more flexible corrections. The reference surface is more preferably designed under the consideration of the optical characteristics thereof in addition to the consideration of the correction quality.

EMBODIMENTS

Embodiment 1

The embodiments of the image display apparatus of the present invention are described.

FIG. 3 is a perspective view of an image display apparatus. In order to show the internal structure thereof, a part thereof is broken. The inside of a lower broken line shows an enlarged sectional view of a seal bonding portion. From FIG. 3, the image display apparatus of the present embodiment is equipped with an envelope 90 which is composed of a rear plate 81, a face plate 82 arranged in opposition to the rear plate 81, and a supporting frame 86 which supports these plates. Many electron-emitting devices 87 which are surface conduction electron-emitting devices here are arranged on the rear plate 81 in a matrix, and a pair of device electrodes of each of these surface conduction electron-emitting devices 87 are connected to X-directional wiring 88 and Y-directional wiring 89, respectively. In the present embodiment, the X-direction is the same as horizontal (column) direction, and the Y-direction is the same as vertical (row) direction. In the present embodiment, the wiring containing silver (Ag) as the main ingredient is used as the X-, Y-wiring. The X-, Y-wiring is insulated by a not shown interlayer insulation layer containing lead oxide (PbO) as the main ingredient. These X-, Y-wiring and the interlayer insulation layer are space structures, and influence the trajectories of electron beams not a little. The face plate 82 is made of a glass substrate 83, and a phosphor 84, a metal back 85 and the like are formed on the inner surface of the face plate 82.

Figure 4A:
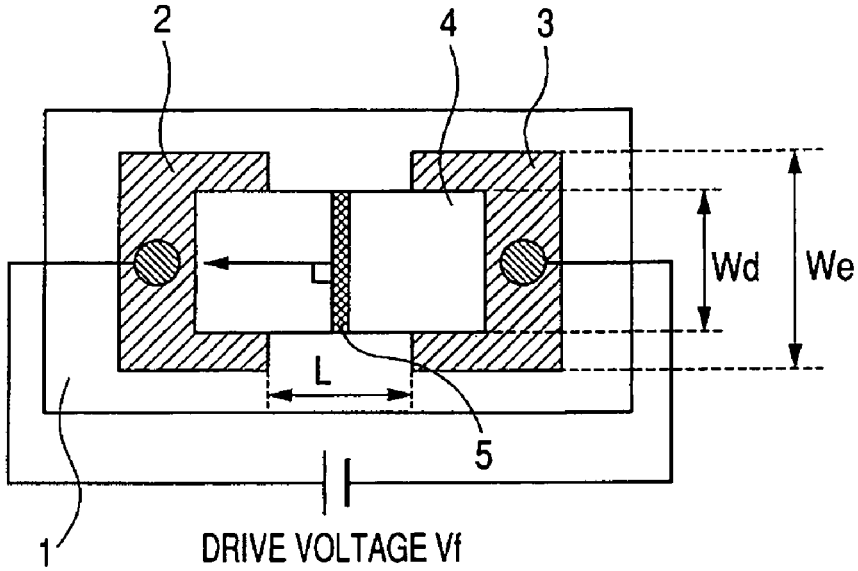
FIGS. 4A and 4B are respectively a view composed of a top view and a sectional view of the basic configuration of a surface conduction electron-emitting device.
Figure 4B:
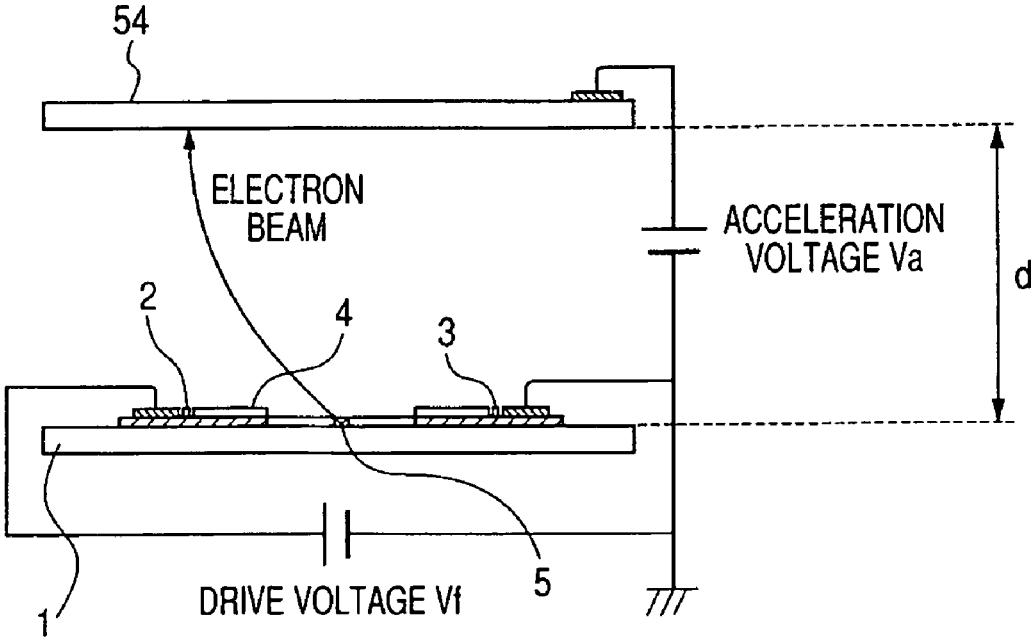

In the present embodiment, a surface conduction electron-emitting device is used as an electron-emitting device formed on the rear plate 81. The basic device configuration of the surface conduction electron-emitting device is described. FIGS. 4A and 4B are respectively a view composed of a top view and a side view of the device configuration.

As shown in FIGS. 4A and 4B, the surface conduction electron-emitting device is configured as follows. That is, a pair of device electrodes 2 and 3 having a device electrode interval L and a device electrode length We are formed on a substrate 1. Furthermore, an electroconductive thin film 4 is formed in the state of straddling the device electrodes 2 and 3, and an electron-emitting area 5 is formed near to the center of the electroconductive thin film 4. Moreover, an anode is installed in opposition to the substrate 1, and a phosphor is applied on the opposed surface.

In the present embodiment, non-alkali glass is used as the substrate 1. The materials of the device electrodes 2 and 3 are conductor materials, and Pt is used in the present embodiment. Film thicknesses depend on the electrical conductivities of the materials, and are about 20 nm in the present embodiment. The device electrode interval L is about 5 μm, the device electrode length We is about 120 μm, and a device length Wd is about 80 μm. The device electrodes 2 and 3 are formed by combining sputtering and photolithography.

A thin film made of fine particles is used as the electroconductive thin film 4 for obtaining a good electron emitting characteristic. The film thickness of the electroconductive thin film 4 is about 10 nm. Palladium (Pd) is used as the electroconductive thin film in the present embodiment. The electroconductive thin film 4 is formed as a film by a method of baking after a solution application.

The electron-emitting area 5 is formed by performing energization processing called as forming after the film-formation of the electroconductive thin film 4. In the present embodiment, after the application of an organic palladium solution, the applied organic palladium solution is baked to form a palladium oxide (PdO) film. Thus, the electroconductive thin film 4 is formed. Then, the electroconductive thin film 4 is subjected to energization heating in a reducing atmosphere in which hydrogen coexists to change the electroconductive thin film 4 to a palladium (Pd) film. By forming a fissure portion at the same time, the electron-emitting area 5 is formed. The voltage at the time of the electrification is ordinarily about 20 V.

Figure 15:
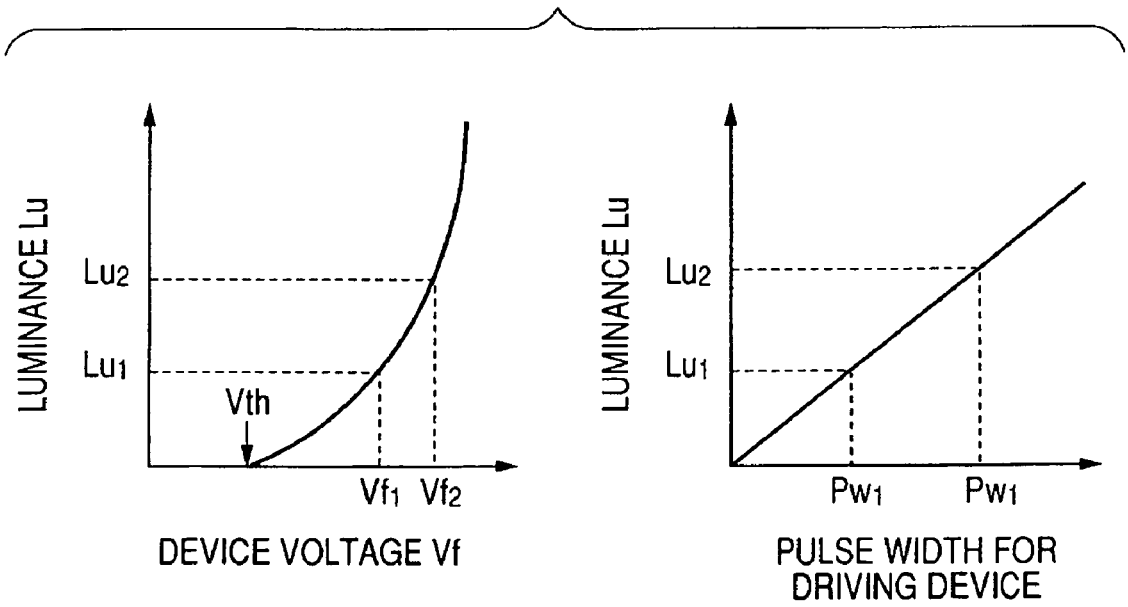
FIG. 15 is a diagram composed of a diagram showing relations between voltages Vf for driving a device and luminance Lu, and a diagram showing relations between pulse widths Pw for driving a device and luminance Lu.

In the surface conduction electron-emitting device constituted as mentioned above, electrons are emitted from the neighborhood of the fissure of the electron-emitting area 5 by applying a voltage between the pair of device electrodes 2 and 3 to flow a current (emission current) on the surface (device surface) of the electroconductive thin film 4. The emitted electrons are accelerated by the anode electrode applied to about 10 kV, and collide with the phosphor of the anode to emit light. The electron-emitting device has characteristics as shown in FIG. 15. When the drive voltage Vf becomes larger than a threshold voltage Vth, the emission current exponentially increases, and the emission light luminance on the anode side phosphor increases. The electron-emitting device has such a switching characteristic. The threshold voltage Vth is about 10V, and the drive voltage Vf is within a range of from 16 V to 20 V. The drive of the device is performed by an alternating current using rectangle pulses, and its luminance also increases according to the pulse width Pw. Incidentally, in the example shown in FIGS. 4A and 4B, although the electron-emitting area 5 is shown as a rectangle at the center of the electroconductive thin film 4, the shape is schematically shown one, and does not faithfully show the position and the shape of the actual electron-emitting area. Although the fissure meanders when it is microscopically observed, the fissure has a shape corresponding to the electrode shape when it is macroscopically seen. An electron is emitted with the initial velocity vector along the electric field direction formed by an electrode near the emitting point. That is, the electron has the initial velocity vector in the direction in which a pair of device electrodes are opposed, and the direction of the initial velocity vector of an electron beam can be designed from the shape of a device electrode.

Figure 14:
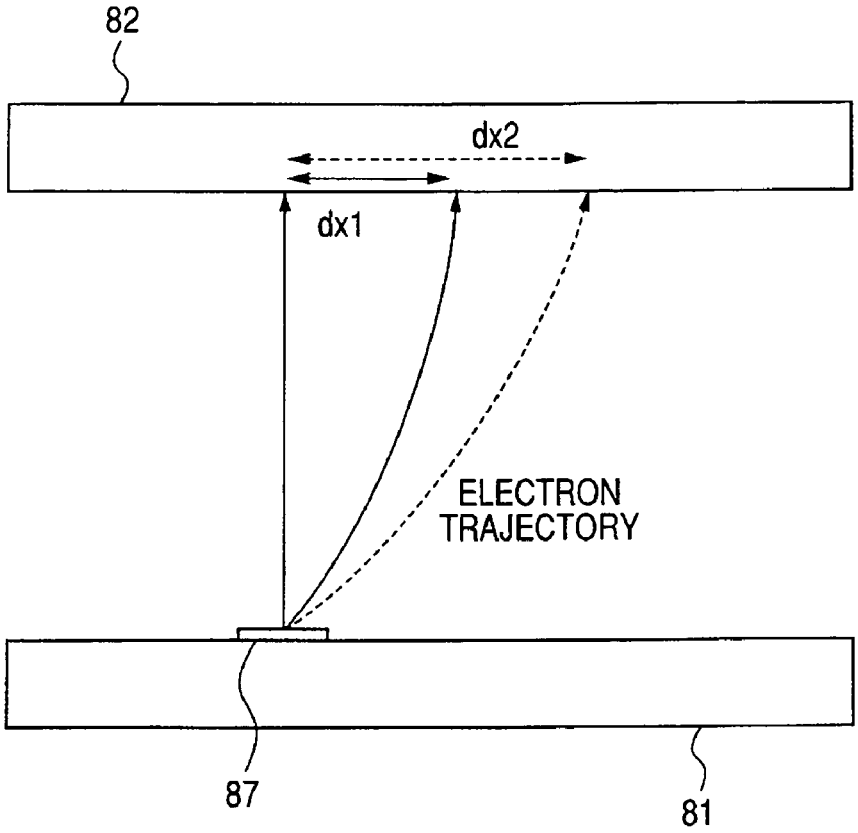
FIG. 14 is a view showing horizontal electron beam incident distances.

Moreover, a locus of an electron is shown in FIG. 14. As shown in FIG. 14, a horizontal electron incident distance dx of an electron beam depends on the emission energy of an electron, and is in proportion to SQRT((Vf−Vφ)/Va) (Vφ denotes a work function).

Figure 6:
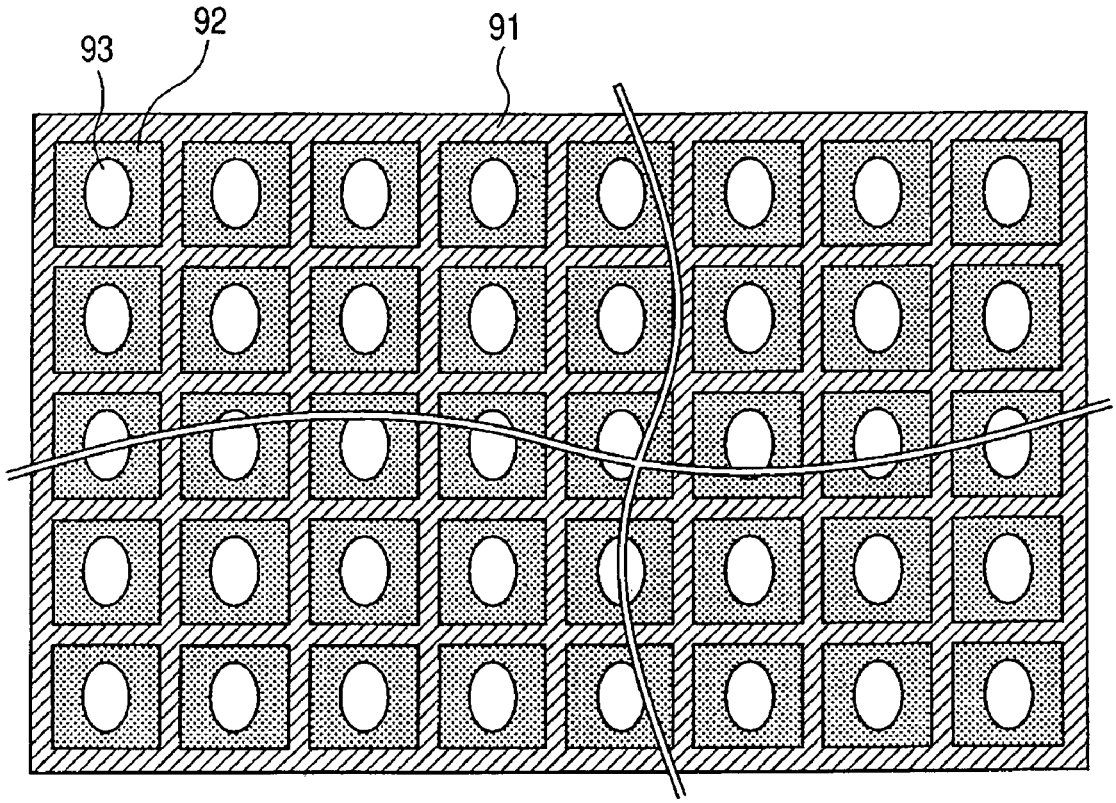
FIG. 6 is a schematic view showing a black conductive material, phosphors and electron beam light-emitting images which are formed on the face plate of an image display apparatus.

FIG. 6 is a view showing a phosphor portion formed on the face plate of the image display apparatus shown in FIG. 3. The phosphor portion is composed of a black conductive materials 91 called as a black stripe or a black matrix by the arrangement thereof, and a phosphor 92. The luminous image 93 of an electron beam is usually designed so that it may come to the center of a phosphor aperture portion. However, when the alignment of the rear plate and the face plate is offset or the warping of the image display apparatus is large, it may also happen that the luminous image 93 does not come to the center of the phosphor aperture portion, and that the luminescence image is eclipsed by the black conductive material. As shown in FIG. 3, the metal back 85 is usually formed on the inner surface side of the phosphor film 84.

The rear plate, the face plate and the supporting frame, which have been mentioned above, constitute the envelope 90 of the image display apparatus shown in FIG. 3. With reference to the inside of the broken line of FIG. 3, the seal bonding structure of the envelope 90 is described. The supporting frame 86 and the rear plate are fixed with frit glass. The supporting frame 86 and the face plate 82 are adhered by the joining member 206. As the joining member 206, a material which is soft and does not emit gasses so much at a high temperature is used in order that the difference of the coefficients of thermal expansion of the rear plate 81 and the face plate 82 can be absorbed. Indium (In) is used in the present embodiment. Under coating layers 204 are formed at positions of the supporting frame 86 and the face plate 82 adhered with the joining members 206 for improving the adhesion properties at the interfaces. Silver, which has good wettability to indium (In), is used in the present embodiment.

Figure 7:
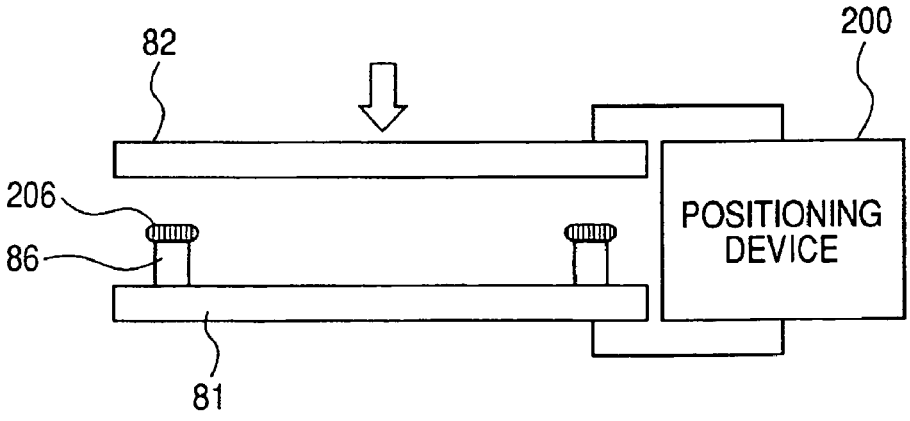
FIG. 7 is a view for illustrating the method of the seal bonding of the image display apparatus.

The procedure of producing the image display apparatus including the seal bonding structure mentioned above is described. First, the supporting frame 86 is adhered to the rear plate 81 with frit glass 203, and the supporting frame 86 is fixed by baking the supporting frame 86 at a temperature of from 400° C. to 500° C. for 10 minutes. After that, the part between the supporting frame 86 and the face plate 82 is subjected to the seal bonding with the joining member 206 to form the envelop 90. As shown in FIG. 7, alignment is performed by a positioning device 200, and a predetermined pressure is applied to the joining member 206 from the both of the face plate 82 side and the rear plate 81 side. Then, heating treatment at 180° C. for about ten minutes is performed under the pressure to join the supporting frame 86 and the face plate 82 with the joining member 206. The whole of the series of the processes is performed in a vacuum chamber, and it becomes possible to make the inside of the envelope 90 to a vacuum from the beginning.

Incidentally, in the image display apparatus of the present embodiment, the envelope 90 having a sufficient strength to the atmospheric pressure also in case of having a large area is configured by installing not shown supporting bodies called as spacers.

Because the joining member 206 has a drawing property, the joining member 206 itself absorbs the stress produced by the difference between the thermal expansion coefficients of the face plate 82 and the rear plate 81 in a cooling process after the heating treatment. Consequently, even if a face plate and a rear plate which have different thermal expansion coefficients from each other are selected as the face plate 82 and the rear plate 81, no defects such as the occurrence of a fissure arise. The thickness of the joining member 206 influences the absorption of the stress by the joining member 206 greatly. When the size of the envelope 90 is small, a vacuum case using the plates made of different glass materials can be relatively easily formed only by adopting a seal bonding structure joined with indium (In). However, if the size of the envelope 90 becomes larger, it becomes impossible to absorb the difference between the coefficients of thermal expansions of different kinds of glass when there is not sufficient thickness of indium (In), and a fissure is produced on a plate. Accordingly, if the size of envelope 90 is larger, it is necessary to make the thickness of indium (In) thicker according to the size of the envelope 90. Experimentally, the thickness of indium (In) is preferably within a range of from 0.05% to 0.5% of the size of the envelope.

Although the occurrence of a fissure is prevented by using a material having a high drawing property such as indium (In) as the joining member 206, a large residual stress occurs in the inside of the joining member in that case, and warping arises in a plate. Because each color phosphor and each electron-emitting device must be made to correspond to each other when the seal bonding of the envelope 90 is performed, it is necessary to perform sufficient alignment by a knocking method of the upper and the lower substrates or the like. However, the offsets of electron beam incident positions which arise by the warping cannot be corrected by the alignment at the time of the seal bonding. If the envelope becomes larger, the problem becomes more remarkable.

In the present embodiment, the offsets of electron beam incident positions caused by the warping are corrected by forming an in-plane distribution of the initial velocity vectors of electron beams by adopting device electrodes each having an oblique shape, as shown later.

From the fundamental characteristic of the surface conduction electron-emitting device element in the present embodiment, which has been mentioned above, an electron emission characteristic is controlled according to the amplitude and the width of a pulse-like voltage which is applied between the opposed device electrodes, and halftones are expressed by the electron emission characteristic. When many electron-emitting devices are arranged, by selecting a line with a scanning line signal to apply the pulsing voltage to each device through an information line signal line, it becomes possible to apply an individual voltage to an arbitrary device, and to control each device independently.

Figure 8:
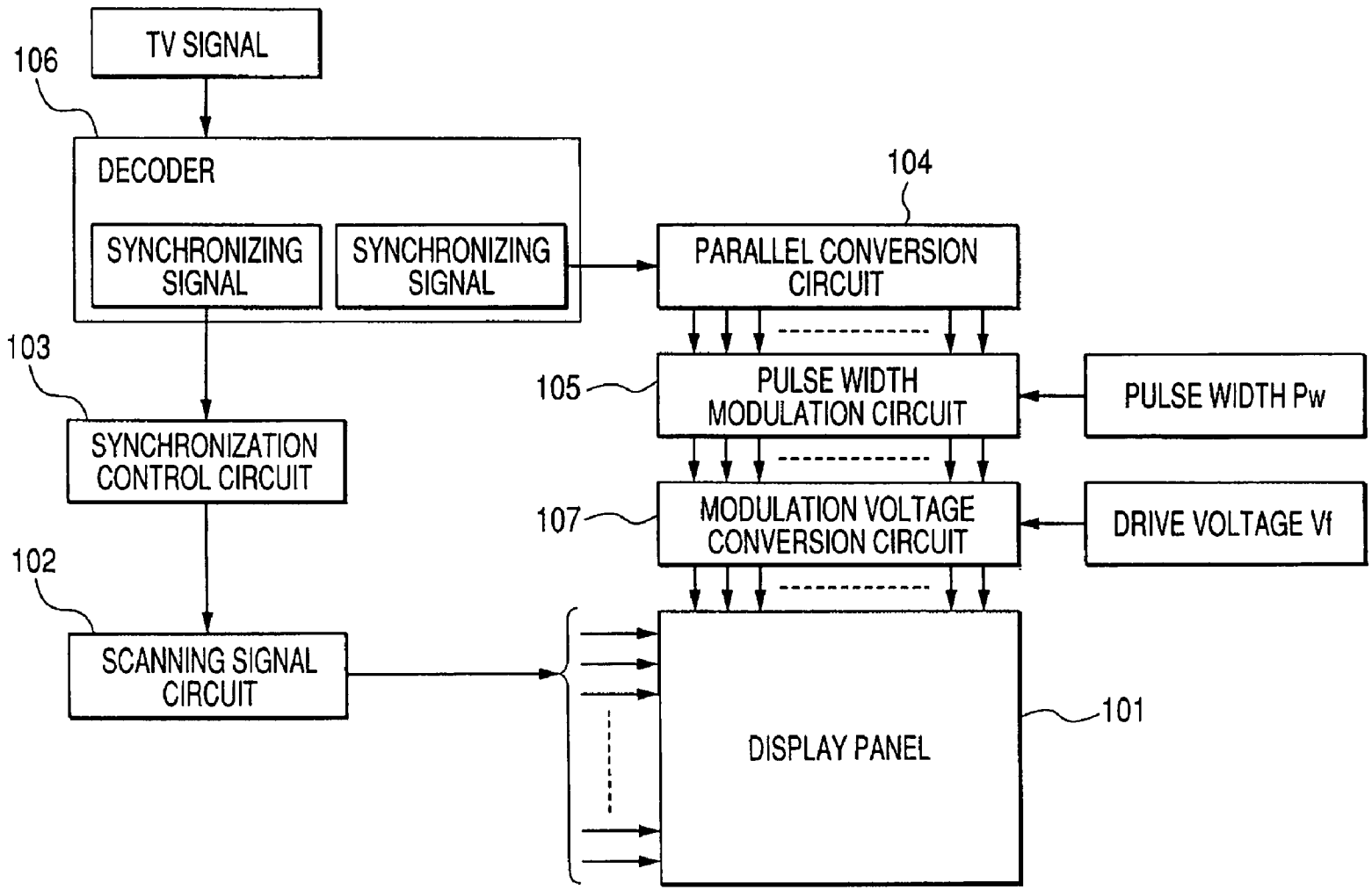
FIG. 8 is a block diagram showing the schematic configuration of an image display apparatus for a television display which is one embodiment of the image display apparatus of the present invention.

A standard drive apparatus of the image display apparatus is described. The block diagram of FIG. 8 shows the schematic configuration of the image display apparatus for a television display based on the TV signal in the present embodiment.

A scanning signal circuit 102 which constitutes a scanning drive circuit applying a scanning line signal is connected to the X-directional wiring of an image display panel 101 using electron-emitting devices. Moreover, a modulation voltage conversion circuit 107 and a pulse width modulation circuit 105, which constitute a data drive circuit applying an information signal to the Y-directional wiring, are connected to the Y-directional wiring. Voltage modulation suitably modulates the amplitude of a pulse to an input voltage pulse. Pulse width modulation modulates the width of a voltage pulse to an input parallel image signal.

A synchronization control circuit 103 sends a synchronization control signal based on a synchronizing signal sent from a decoder 106. The decoder 106 is a circuit for separating synchronizing signal components and image signal components from a TV signal input from the outside. The image signal components are input into a parallel conversion circuit 104 in synchronization with the synchronizing signal.

The operation of the parallel conversion circuit is controlled based on a signal sent from a control circuit 103, and the parallel conversion circuit 104 performs the serial-parallel conversion of the image signal, which is serially input in time series. The image data having been subjected to the serial-parallel conversion is output as parallel signals for n electron-emitting devices.

The pulse width modulation circuit 105 and the modulation voltage conversion circuit 107 convert each luminance signal into a pulse width and a modulation signal, which are applied to each electron-emitting device. The output signals of the modulation voltage connection circuit 107 enter the inside of the image display panel 101 through the Y-directional wiring, and are applied to the respective electron-emitting devices located at the intersection points with the scanning lines selected by the X-directional wiring. By performing the progressive scan of the X-directional wiring, the electron-emitting devices on the whole surface of the image display apparatus are driven.

As described above, in the present embodiment, a voltage is applied to each electron-emitting device through X-, Y-wiring in the image display apparatus to make the electron-emitting device emit electrons. Then, together with the emission of the electrons, a high voltage is applied to the metal back 85, which is the anode electrode, through the high voltage terminal Hv, and the electrons emitted from each electron-emitting device are accelerated to collide with the phosphor. Thereby, an image can be displayed. The configuration of the image forming apparatus is an example of the image forming apparatus of the present invention, and various modifications can be performed based on the technical sprit of the present invention. As the input signals, there are signals of the systems of NTSC, PAL, HDTV and the like.

The corrections of offsets of electron beam incident positions of the present embodiment are described.

Figure 9:
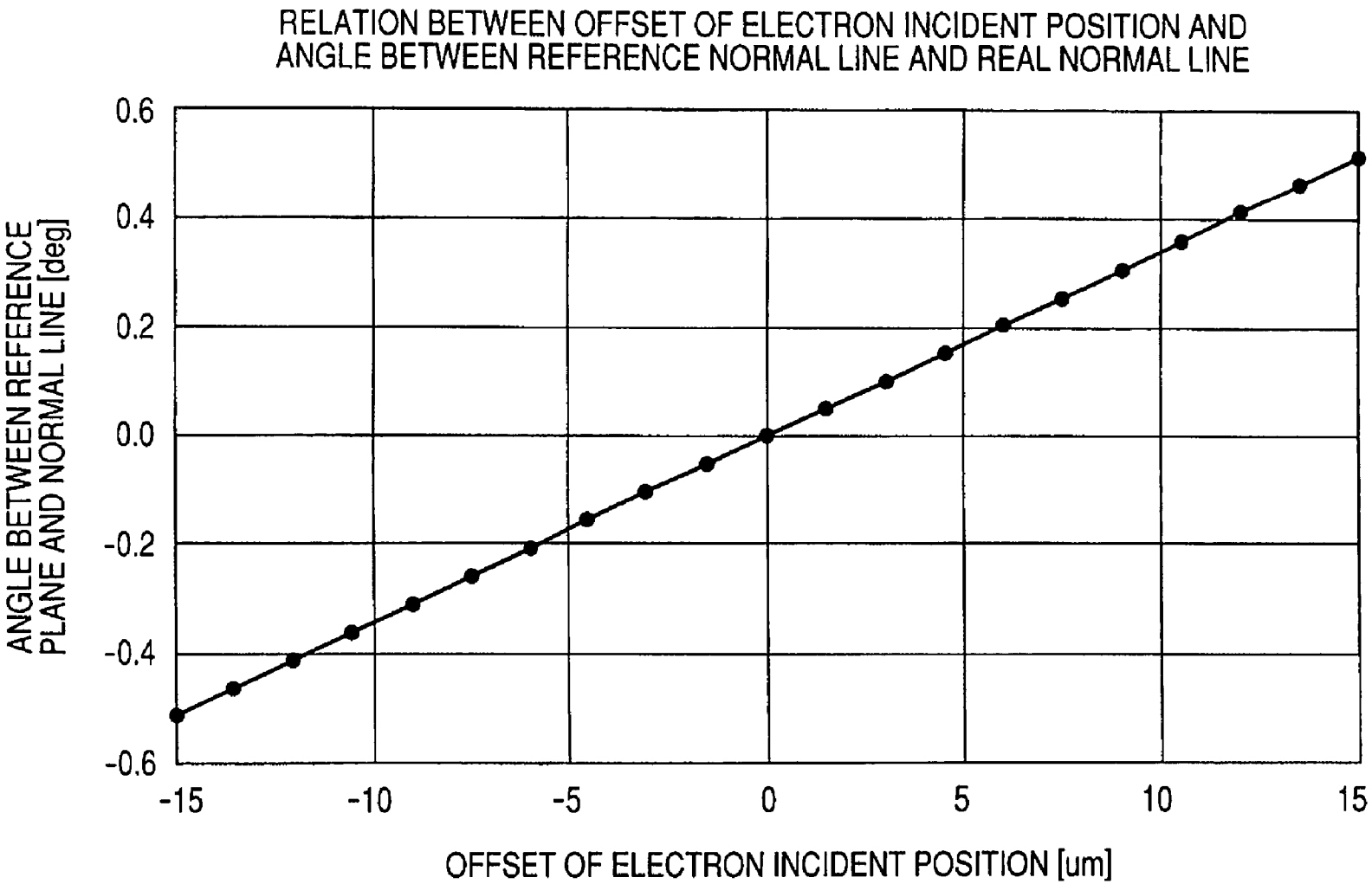
FIG. 9 is a diagram showing relations between the offsets of electron incident positions, and angles between a reference normal line and a real normal line.

Warping in a seal bonding process has reproducibility to a certain extent. In an image display apparatus warped as shown in FIG. 1A, it is called as "an angle between a reference normal line and a real normal line" how much an arrival point of a normal line extended from an electron-emitting device on the rear plate to the face plate is offset from an ideal light emitting position. Hereupon, the ideal light emitting position means a formation position of a light emitting member corresponding to the electron-emitting device. Moreover, the "an angle between a reference normal line and a real normal line" means the angle formed by the normal line of the reference plane and the real normal line of the rear plate. The "an angle between a reference normal line and a real normal line" is calculated based on an actually measured average value of the warping. Moreover, a surface perpendicular to the vector mean of the normal lines is used as the reference plane. FIG. 9 shows angles between the reference plane and the normal lines when a light emitting point on the face plate in the present embodiment is offset to either of the X-direction and the Y-direction. Although the reference surface is a flat plane in the present embodiment, the reference surface is not limited to the flat plane when it is better to regard the reference surface as a curved surface owing to an optical characteristic.

Figure 5:
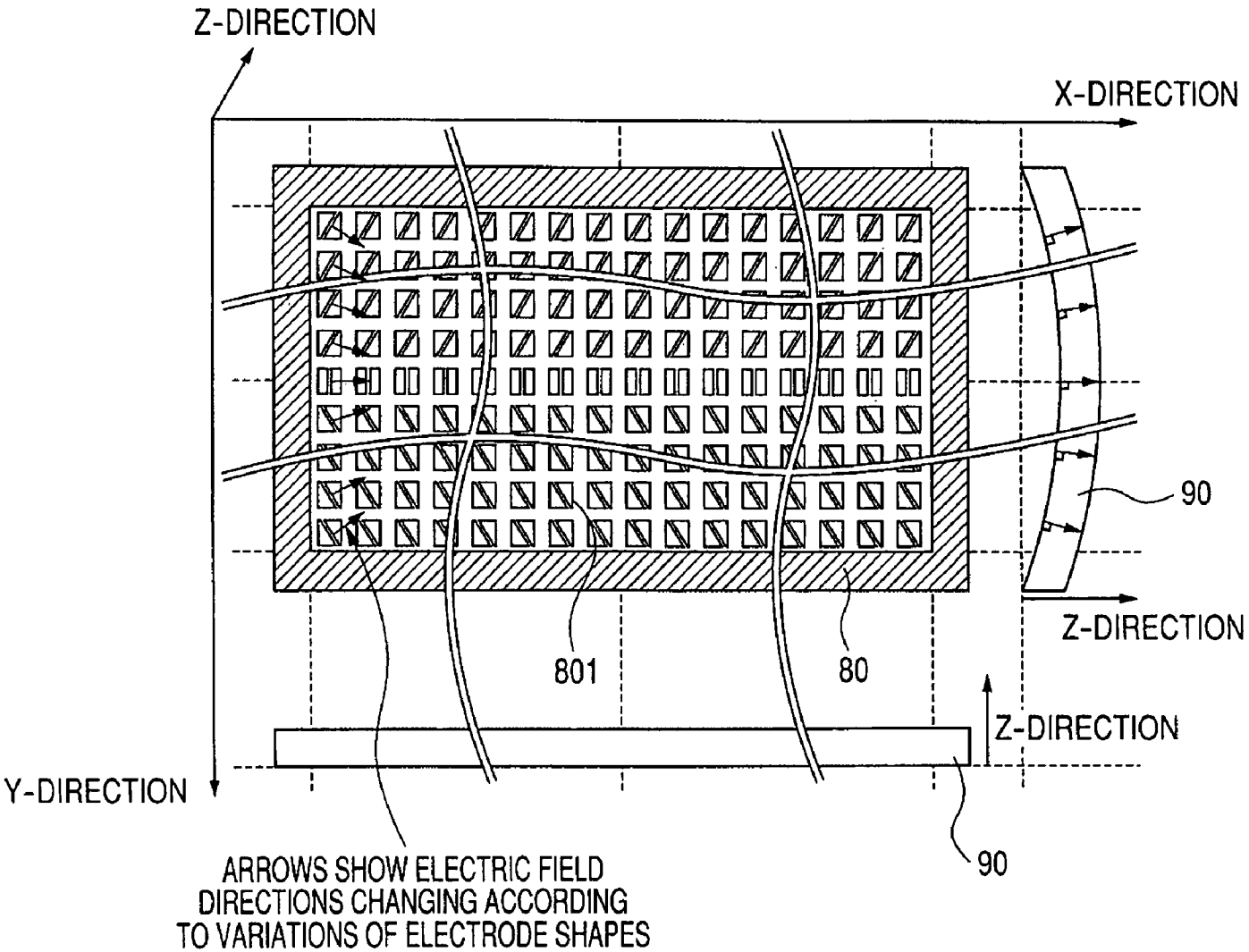
FIG. 5 is a schematic view of the display apparatus in the case where device electrodes are formed with inclinations to produce an in-plane distribution.
Figure 10:
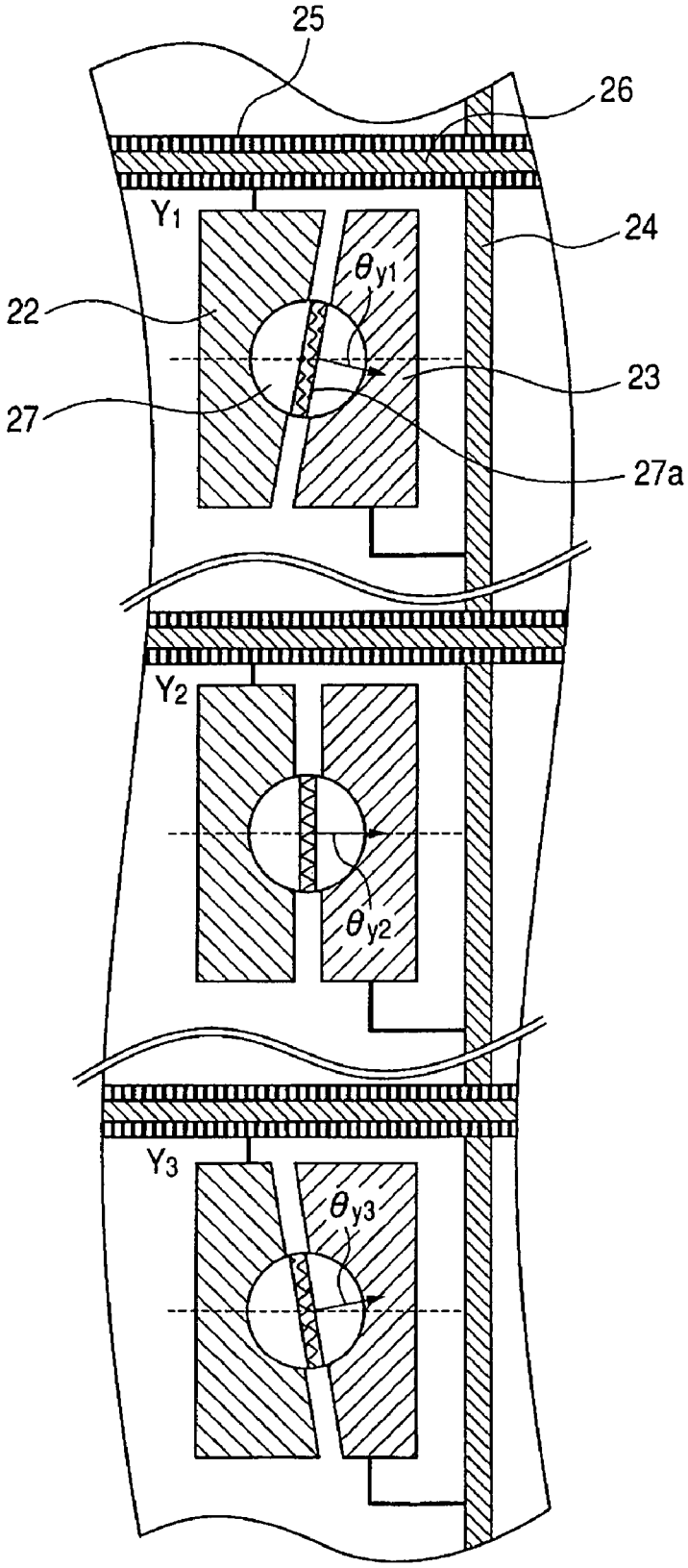
FIG. 10 is a view showing electrode shapes in a first embodiment of the present invention.
Figure 11:
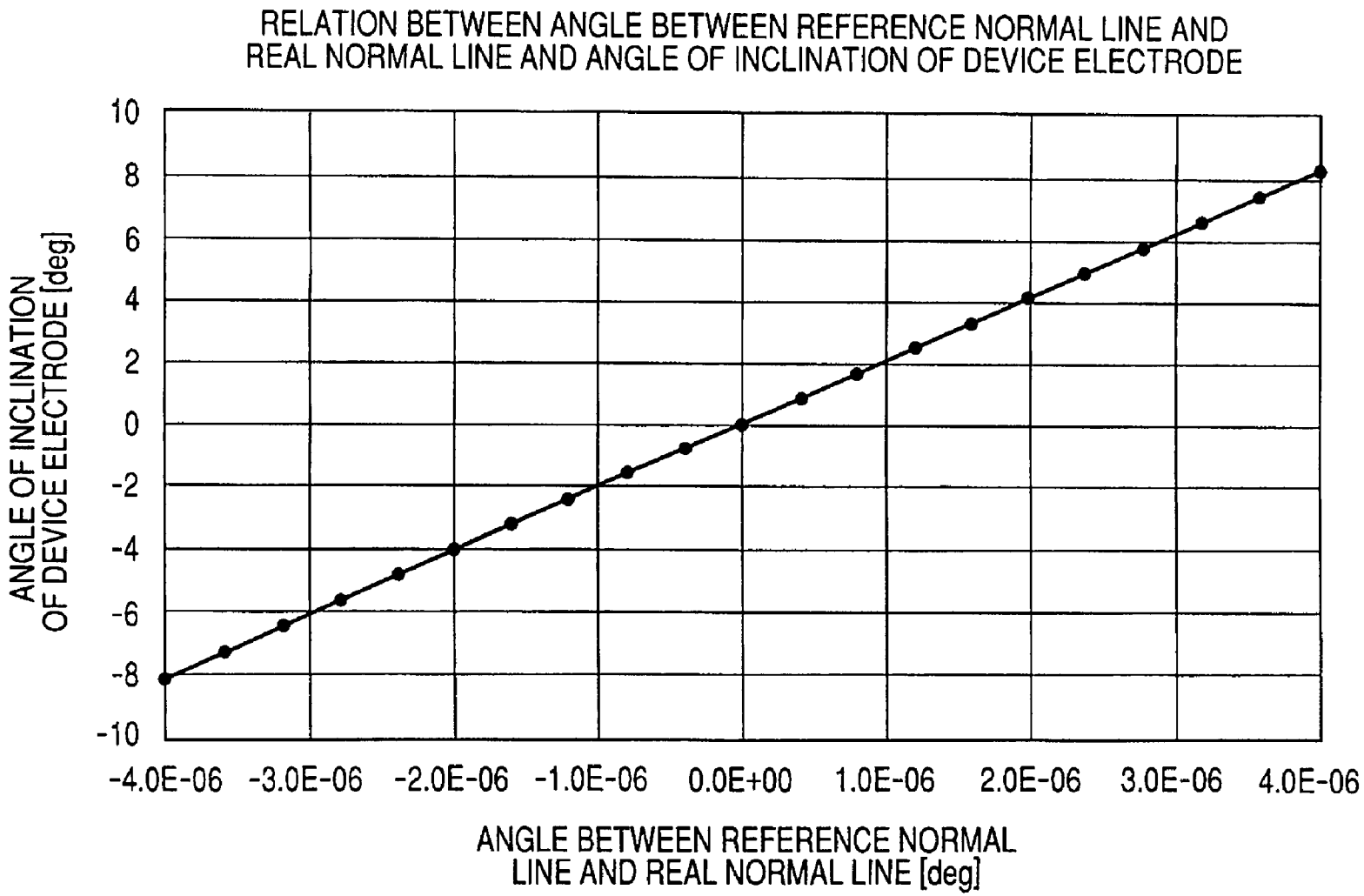
FIG. 11 is a diagram showing relations between angles between a reference plane and normal lines, and angles of the inclinations of device electrodes in the first embodiment of the present invention.

When device electrodes are angled to the X-, Y-directions (the direction in which the X-directional wiring extends is referred to as the X-direction, and the direction in which the Y-directional wiring extends is referred as the Y-direction) as shown in FIG. 10, the electric field directions by the device electrodes become the directions perpendicular to the inclinations of the electrodes. Because the electron beam emitted from an electron source flies along an electric field direction as the electron beam locus shown in FIGS. 4A and 4B, the electron beam has a velocity vector in the Y-direction. As a result, the electron beam incident position where the electron beam reaches the face plate is offset according to the inclination angle of the device electrode. FIG. 11 shows relations between angles between the reference plane and normal lines and angles θy of the inclinations of device electrodes. If the relations of FIG. 11 are made to correspond with the positional offsets of FIG. 9, the suitable angles of the device electrodes can be selected. For example, when the offset of an electron incident position is 5 μm, the corresponding angle between a reference normal line and a real normal line is 0.17 deg in case of being based on FIG. 9. Then, from FIG. 11, it is known that the angle of the device electrode is about 2.5 deg. Based on this correspondence, device electrodes which have angles corresponding to warping beforehand are previously formed at the time of a device electrode formation process, and the offsets of electron beam incident positions by the warping are corrected. A schematic view of the device electrodes which are formed to have angular distribution over the whole area of the image display surface is shown in FIG. 5. In FIG. 5, the warping mainly exists in Y-direction. In the case of the warping in X-direction is considerable, the correction for X-direction is needed. In the present embodiment, the device electrodes are formed by general sputtering-photolithography etching processes. Consequently, although a mask of the exclusive use corresponding to the warping is required, compared with other processes, such as screen printing, pattern accuracy is higher, and because the accuracy of the corrections of electron beam positions is better, the sputtering-photolithography etching processes are preferable.

As described above, in the present embodiment, the offsets of the beam incident positions which are caused by warping remaining in an image display apparatus are corrected by forming an in-plane distribution in the angles of device electrodes.

Embodiment 2

Figure 12:
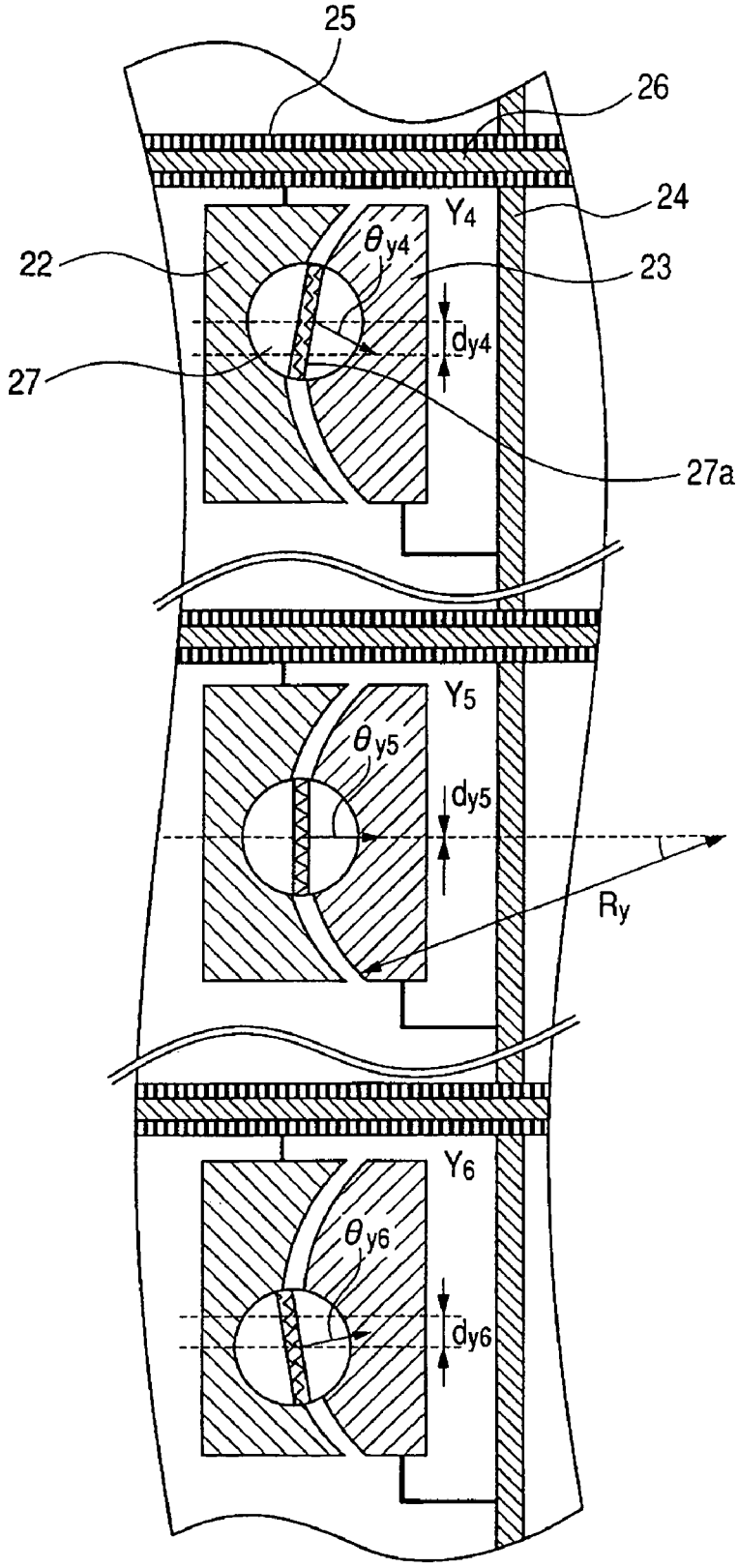
FIG. 12 is a view showing the electrode shapes in a second embodiment of the present invention.
Figure 13:
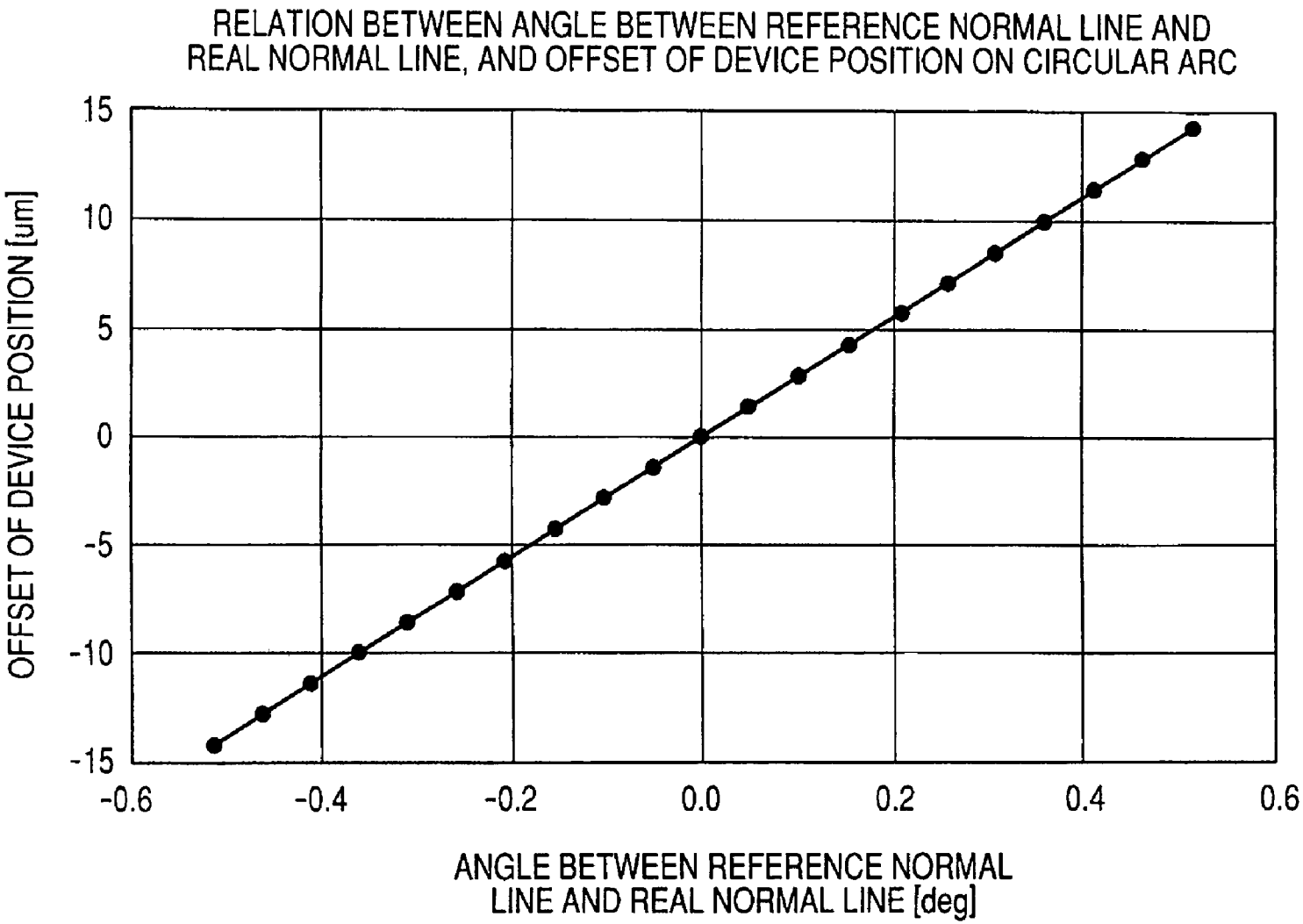
FIG. 13 is a diagram showing relations between angles between a reference normal line and a real normal line, and offsets of device positions on circular arcs in the second embodiment of the present invention.

The present embodiment is a case where electrode shapes are arcs as shown in FIG. 12, and the other configurations of the present embodiment are the same as those of Embodiment 1. In this case, if in the Y-direction electron-emitting areas are formed at predetermined angle positions dy4-dy6 on electrodes like Y4-Y6 of FIG. 12, as described in Embodiment 1, the initial velocity vector of an electron beam can be arbitrarily selected. That is, the electron beam incident positions are made to arrive at the right positions by forming the in-plane distribution at the positions of the electron-emitting areas. FIG. 13 is a diagram showing relations between angles between a reference plane and normal lines, and offsets of corresponding electron-emitting area positions in the case where electrode radii Ry are 100 μm. By making the relations of FIG. 13 correspond with the positional offsets of FIG. 9 by the similar method to that of Embodiment 1, the suitable offsets of electron-emitting area positions can be selected. For example, when the offset of an electron incident position is 5 μm, the corresponding angle between the reference normal line and a real normal line is 0.17 deg in case of being based on FIG. 9. Then, from FIG. 13, it is known that the offset of the electron-emitting area position at this time is about 4.5 μm. Because in some solid structures of the matrix wiring the relations of FIG. 13 are influenced by the matrix solid structure as the positions of electron-emitting areas are more offset from the center, the relations of FIG. 13 become nonlinear in some cases. In such cases, the relations of FIG. 13 can be redrawn by an actual measurement or a simulation. In the system of the present embodiment, although the correction range is narrow, even when a design is changed, the point that there is no necessity of changing a mask is the feature. In case of producing device films by an inkjet process, it is possible to perform different corrections by changing the impact positions of droplets discharged from an inkjet to each image display apparatus. In this case, for example, an adjustment according to warping can be performed to each rear plate substrate.

Embodiment 3

In the present embodiment, electrode angles are zero degree (the opposed portions of a pair of the device electrodes are parallel to the Y-directional wiring) over the whole surface of the image display apparatus. However, the present embodiment makes electron beam incident positions arrive at correct positions on the face plate by forming an in-plane distribution in a beam controlling effect owing to a matrix configuration. In the following, the present embodiment is described in detail.

Figure 18:
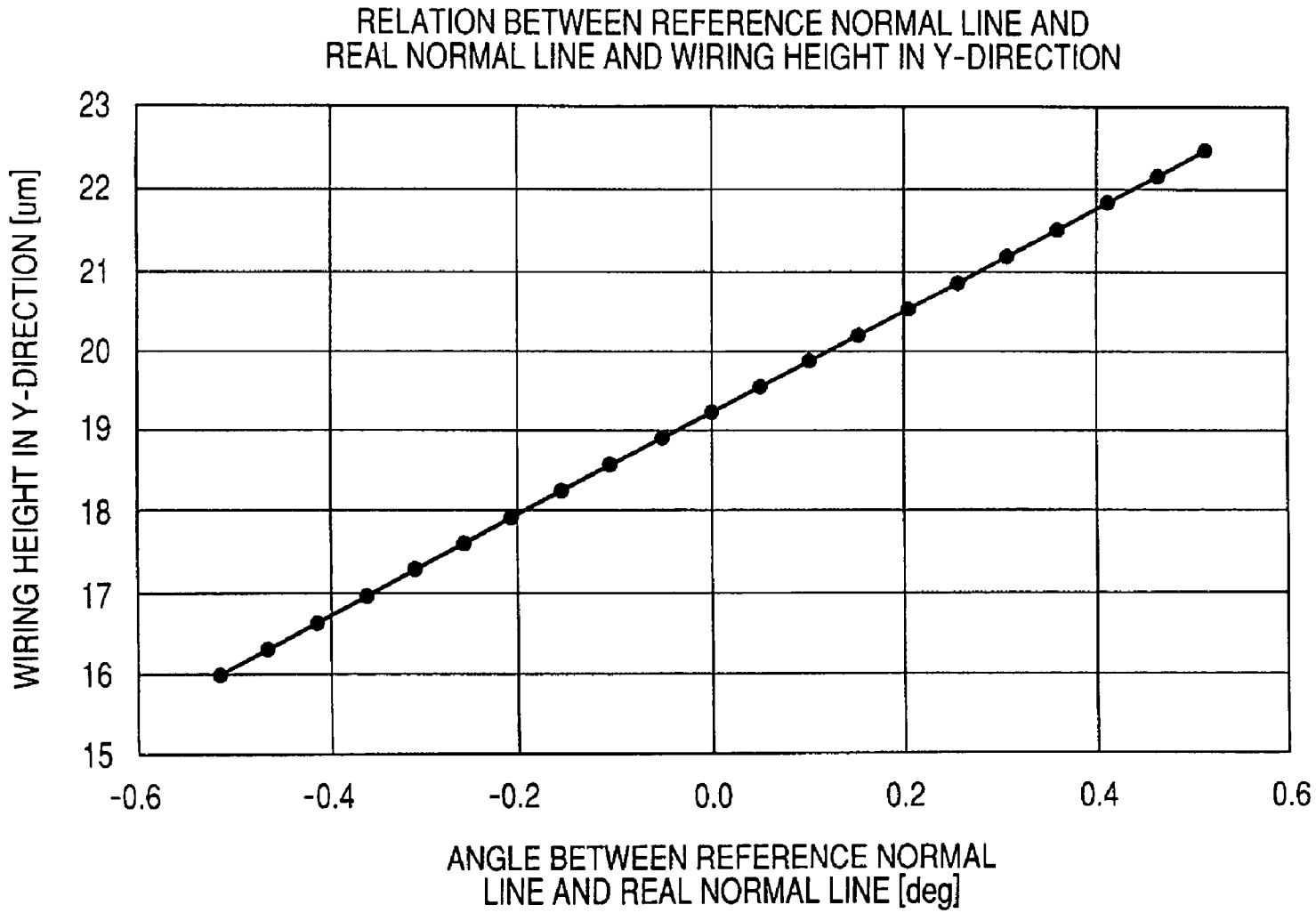
FIG. 18 is a diagram showing relations between angles between a reference normal line and a real normal line, and wiring heights in Y-directions in the third embodiment of the present invention.
Figure 19:
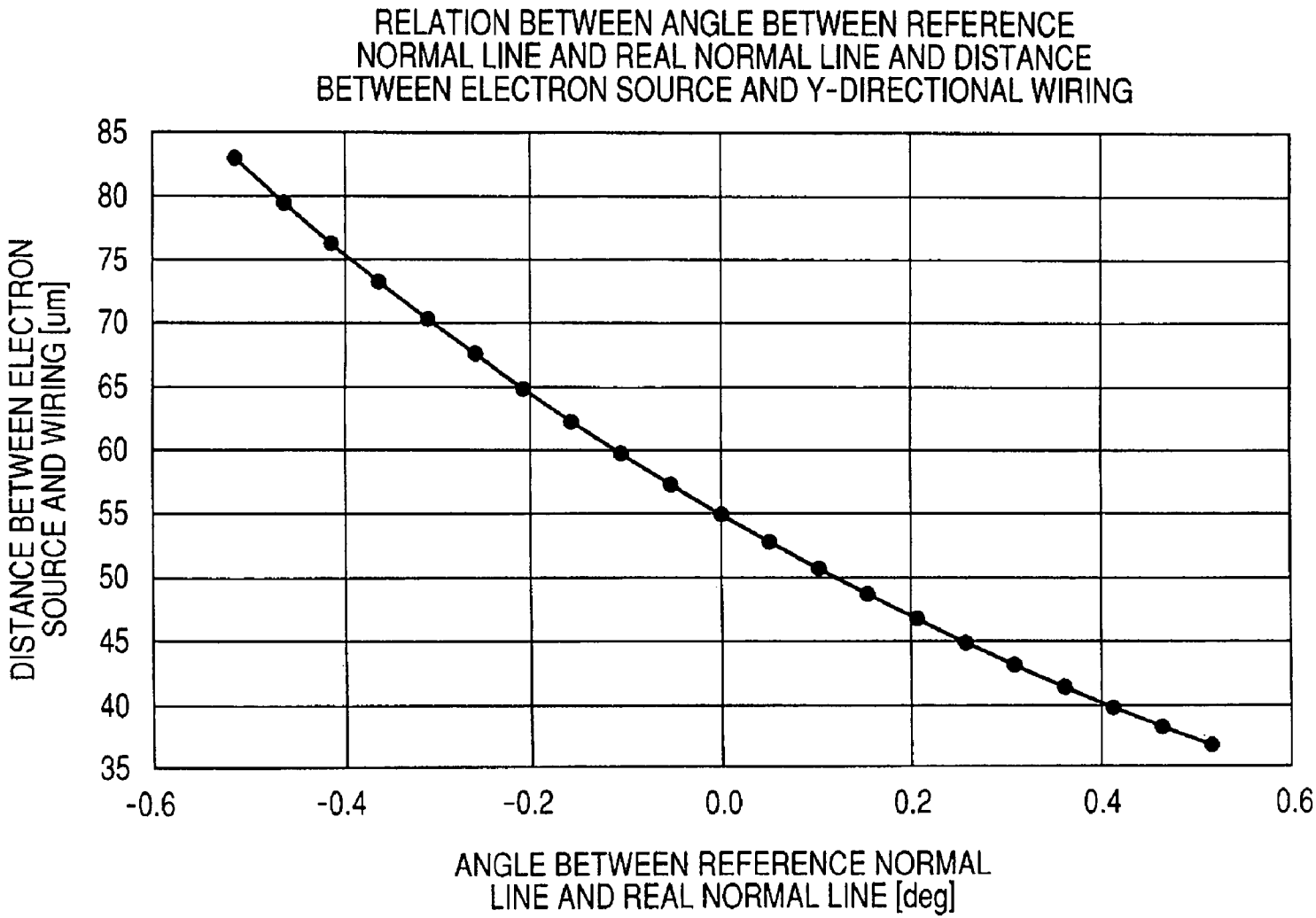
FIG. 19 is a diagram showing relations between the angles between the reference normal line and a real normal line, and distances between an electron source and the Y-directional wirings in the third embodiment of the present invention.

The solid structure of the Y-directional wiring influences the horizontal electron incident distance dx of an electron beam. The main parameters of the Y-directional wiring are the distance xd from the electron source, and the wiring height hd in the Y-direction, and these influence an electron trajectory. To put it concretely using FIG. 17, when the distance xd becomes small, the trajectory of an electron beam changes, for example, from dx4 to dx3, as if it repels the Y-directional wiring. Moreover, when the height hd becomes high, the trajectory of an electron beam also changes as if it repels the Y-directional wiring. FIG. 18 shows the relations between the angles of a reference plane and normal lines and wiring heights in the Y-direction in the case where the distance between an electron-emitting area and the Y-directional wiring is 55 μm, which relations were obtained by fitting the results experimentally obtained. FIG. 19 similarly shows the relations between the angles between a reference plane and normal lines, and the distances between electron-emitting areas and the Y-directional wiring in the case where the wiring height in the Y-direction is 19.5 μm. By the similar method to that of Embodiment 1, these are made to correspond to the relations of FIG. 9 to perform suitable corrections of electron incident positions. For example, in the case where the offset of an electron incident position is 5 μm, the corresponding angle between the reference normal line and a real normal line is 0.17 deg from FIG. 9. From FIG. 18, it is known that the wiring height in the Y-direction at this time is 20.3 μm. Moreover, when the offset of an electron incident position is 5 μm, the corresponding angle of a reference plane and a normal line is about 0.17 deg from FIG. 9. From FIG. 19, it is known that the distance between the electron-emitting area and the wiring at this time is 48 μm.

In the above-mentioned embodiments 1-3, further the voltage Vf applied to an electron-emitting device may be adjusted to each element, and the electron beam incident positions may be further adjusted. This is described in detail below.

Figure 16:
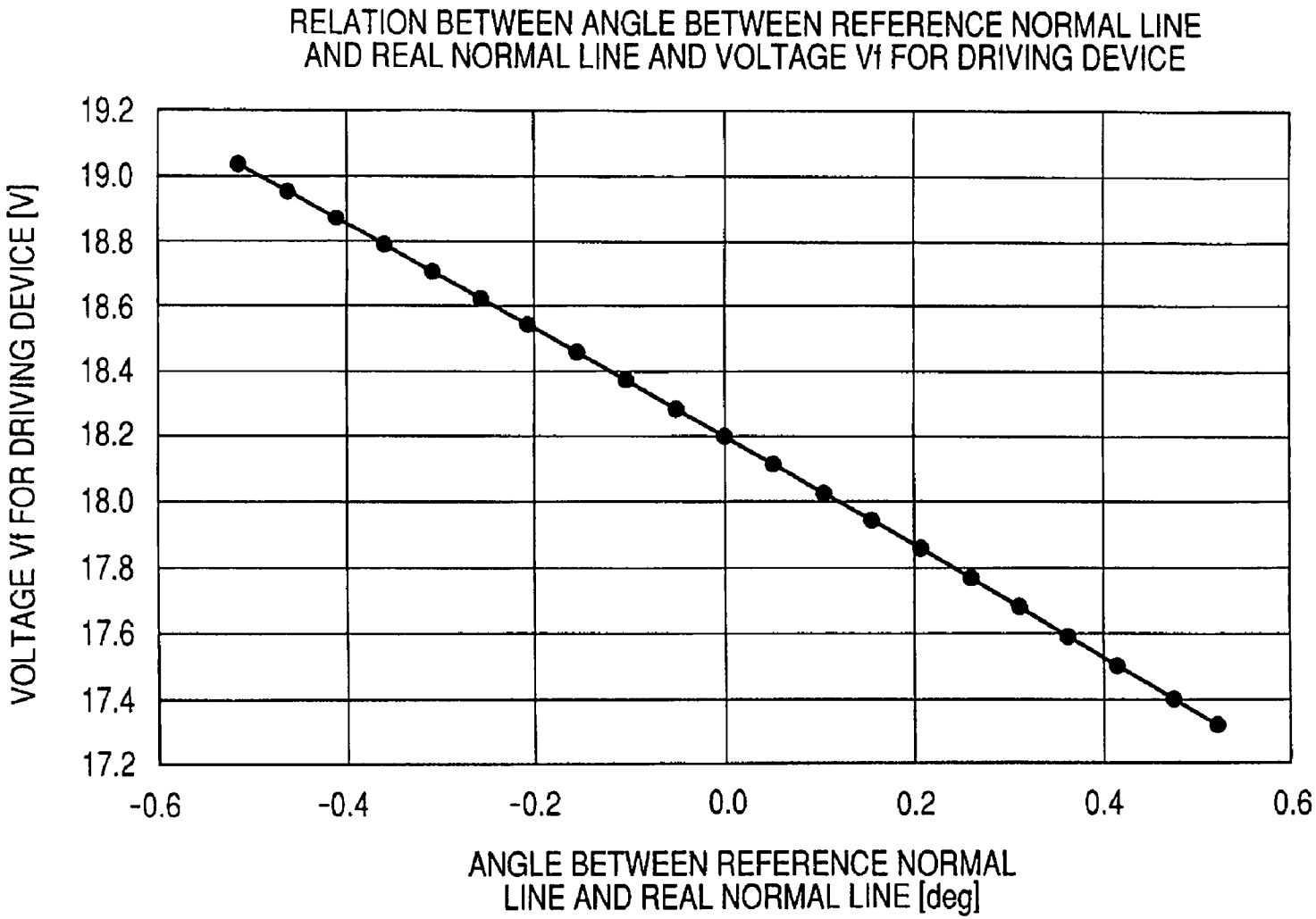
FIG. 16 is a diagram showing relations between angles between reference normal line and a real normal line, and voltages Vf for driving a device.

It is known that the horizontal electron incident distance dx of an electron beam depends on emission energy, and is proportional to SQRT (Vf−Vφ)/Va) (Vφ denotes a work function and Va denotes an anode voltage). If correction is performed to the voltage Vf for driving a device to the offset of an electron incident position shown in FIG. 9 similarly to Embodiment 1 as shown in FIG. 16, then the position of the electron beam can be further adjusted.

However, because a change of luminance is also caused in this case, it is preferable to change the pulse width Pw for driving a device according to a change of the luminance owing to the voltage Vf for driving a device so as to correct the change of the luminance. As shown in FIG. 15, when the luminance has changed by a drive voltage from Lu1 to Lu2 in the diagram, a drive pulse is adjusted from Pw1 to Pw2, and the change of the luminance by the drive voltage is corrected. The quantity of the correction depends on the characteristic of the electron source. In the present embodiment, when the drive voltage Vf has been changed from the state in which the drive voltage Vf is 19.2 V, the pulse width Pw is 6.7 μs, and the luminance is 200 cd/cm$^2$, almost the original luminance can be obtained at the pulse width Pw is 10.8 μs. There is no necessity of performing this correction in real time, and the relations between the drive voltages measured beforehand and the pulse widths may be given as a correction table for the in-plane distribution. That is, when there are no corrections, the relations between the pulse widths Pw and the drive voltages Vf, which are supplied to the pulse width modulation circuit 105 and the modulation voltage conversion circuit 107 shown in FIG. 8, are one kind to an image signal. However, when a correction exists, there is a plurality of the relations according to the divided blocks for correction in a surface. Although the present system does not change anything in a producing process of an image display apparatus, the correction range is narrow to be within several μm.

Figure 21:
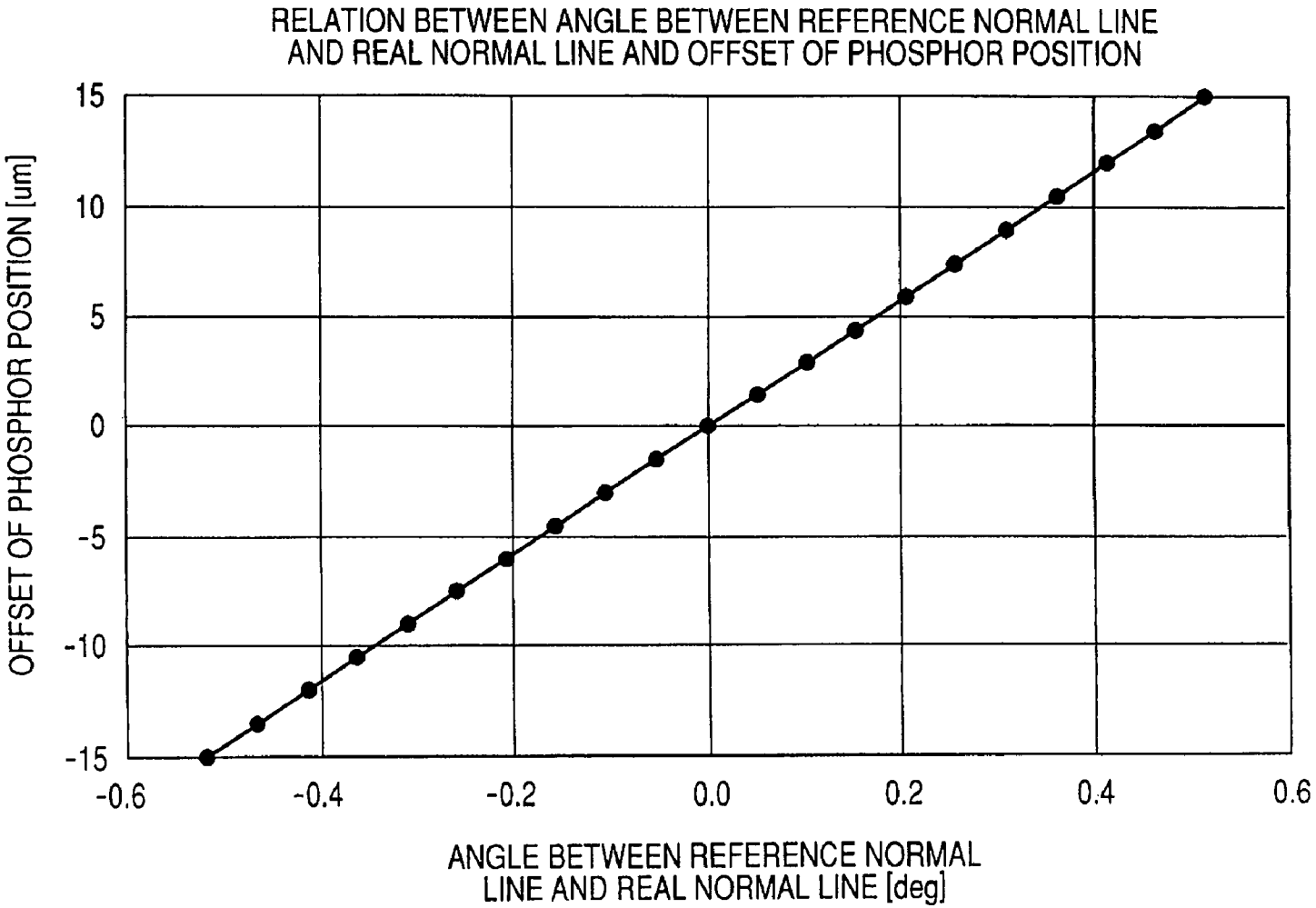
FIG. 21 is a diagram showing relations between angles between a reference normal line and a real normal line, and the offsets of phosphor positions.

Moreover, when the warping of the image display apparatus exceeds a certain degree of a range in the first to the third embodiments, the warping cannot be dealt with only on the rear plate side. For example, in the first embodiment, it is not preferable for designing a pattern that the electrode angles exceed 10 degrees. Then, is such a case, the position of the light emitting portions are made to agree with electron beam incident positions by forming an in-plane distribution at the positions of phosphor to complement the corrections of the offsets of electron incident positions by electron beam control. The relations between the angles between the reference plane and normal lines, and the offsets of phosphor positions at the time of considering only the phosphor position movements are shown in FIG. 21. Moreover, the positions of phosphors are described using FIG. 20. A reference mark dy denotes an offset quantity of the center of a phosphor position to a phosphor pitch in the Y-direction. Hereupon, the phosphor pitch means a reference pitch (target value) set on the supposition that no warping exists. A reference mark Y8 denotes a phosphor located at a standard position. Because at the phosphor Y8 the center of the phosphor position is not offset from the phosphor pitch, an offset quantity dy8 is zero. When an electron beam emitting portion does not fall in the opening region of a phosphor in a region near to the end of the image even if the corrections shown in Embodiments 1-3, the correction of an electron beam incident position is further complemented by offsetting a phosphor position like a phosphor Y7 or a phosphor Y9. However, because the complement changes the pitch of the phosphors and the case where the change is not optically preferable can be considered, the magnitudes of the offset quantities dy7-dy9 are preferably less than 10 μm. The system of offsetting the phosphor positions can be realized by changing a mask such as a black conductive material of the face plate.

In each embodiment described above, although the surface conduction electron-emitting device is cited as an example as the electron-emitting device formed on the electron source substrate, the present invention is not limited to use the surface conduction electron-emitting device. For example, the other electron-emitting devices such as a field emission type device may be used.

Moreover, the present invention corrects the positional offsets produced by warping, and is not limited about the kinds of the positional offsets by the warping. For example, also in the case of the offsets when the rear plate and the face plate are not parallel, the present invention can deal with such offsets, though a formula changes.

Furthermore, although the case where each embodiment is independent has been described in the present embodiments 1-3, the present invention is not limited to such a case, and can attain the object by combining each embodiment.

As described above, according to the present invention, even when warping owing to a residual stress exists in an image display apparatus in which the rear plate thereof and the face plate thereof are adhered to each other by seal bonding, a high quality image display apparatus having no luminance dispersion and color dispersion can be provided.

Moreover, according to the present invention, because larger warping is permissible, the thicknesses of the face plate and the rear plate can be made thinner than those of the conventional ones. And, as a result, not only a light and inexpensive image display apparatus can be provided, but also an image display apparatus having a larger and high-definition screen can be provided.

This application claims priority from Japanese Patent Application No. 2004-376642 filed Dec. 27, 2004, which is hereby incorporated by reference herein.

What is claimed is:

1. A display apparatus, comprising:

an electron source substrate having an electron source including a plurality of electron-emitting devices, each having an electron-emitting area between a pair of electrodes, a plurality of row directional wirings and a plurality of column directional wirings, both of said wirings connecting said plurality of electron-emitting devices; and a counter substrate located in opposition to the electron source substrate, said counter substrate including a plurality of light emitting portions corresponding to said plurality of electron-emitting devices, wherein said electron source substrate is warped, and counter surfaces of the pairs of the electrodes of the plurality of electron-emitting devices are angled to the column directional wirings respectively, and the angles vary correspondingly to warping in said electron source substrate, so that electrons emitted from each of said plurality of electron-emitting devices may irradiate each of said plurality of light emitting portions which correspond to said electron-emitting devices.

2. An image display apparatus according to claim 1, wherein said counter surfaces of said pair of device electrodes have curvatures, and a position of the electron-emitting area between said counter surfaces having said curvatures is adjusted to correspond to said warping in the electron source substrate.

3. An image display apparatus according to claim 1, wherein pitches between adjoining light emitting portions of said plurality of light emitting portions vary correspondingly to the warping.

4. A display apparatus comprising:

an electron source substrate having an electron source including a plurality of electron-emitting devices, each having an electron-emitting area between a pair of electrodes, a plurality of row directional wirings and a plurality of column directional wirings, both of said wirings connecting said plurality of electron-emitting devices; and a counter substrate located in opposition to the electron source substrate, said counter substrate including a plurality of light-emitting portions corresponding to said plurality of electron-emitting devices, wherein said electron source substrate is warped, a distance between each of said electron-emitting areas of said plurality of electron-emitting devices and said column directional wirings near to said electron-emitting areas varies correspondingly to warping in said electron source substrate, so that electrons emitted from each of said plurality of electron-emitting devices may irradiate each of said plurality of light emitting portions which correspond to said electron-emitting devices.

5. A display apparatus comprising:

an electron source substrate having an electron source including a plurality of electron-emitting devices, each having an electron-emitting area between a pair of electrodes, a plurality of row directional wirings and a plurality of column directional wirings, both of said wirings connecting said plurality of electron-emitting devices; and a counter substrate located in opposition to the electron source substrate, said counter substrate including a plurality of light emitting portions corresponding to said plurality of electron-emitting devices, wherein said electron source substrate is warped, a height of said column directional wirings near to each of said electron-emitting areas of said plurality of electron-emitting devices varies correspondingly to warping in said electron source substrate, so that electrons emitted from each of said plurality of electron-emitting devices may irradiate each of said plurality of light emitting portions which correspond to said electron-emitting devices.

* * * * *